US005595067A

United States Patent [19]

Maness

[11] Patent Number: 5,595,067

[45] Date of Patent: Jan. 21, 1997

[54] ENERGY PUMP

[76] Inventor: James E. Maness, 8918 S. Union, Tulsa, Okla. 74132

[21] Appl. No.: 353,096

[22] Filed: Dec. 9, 1994

[51] Int. Cl.[6] ..... F25D 9/00

[52] U.S. Cl. ..... 62/401; 62/402; 418/30; 418/31

[58] Field of Search ..... 418/30, 31; 62/401, 62/402

[56] References Cited

U.S. PATENT DOCUMENTS

| | | | |
|---|---|---|---|
| 3,686,893 | 8/1972 | Edwards | 62/402 |
| 3,808,814 | 5/1974 | Macy, II | 418/31 |
| 3,956,904 | 5/1976 | Edwards | 62/402 |
| 3,977,852 | 8/1976 | Edwards | 62/402 |
| 4,064,705 | 12/1977 | Edwards et al. | 62/2 |
| 4,088,426 | 5/1978 | Edwards | 418/8 |
| 4,187,693 | 2/1980 | Smolinski | 62/402 |
| 4,235,079 | 11/1980 | Masser | 62/87 |
| 4,241,591 | 12/1980 | Edwards | 62/402 |
| 4,279,291 | 7/1981 | Lambert | 165/1 |
| 4,340,338 | 7/1982 | Lemke | 418/31 |
| 4,478,046 | 10/1984 | Saito et al. | 62/6 |
| 5,239,833 | 8/1993 | Fineblum | 62/6 |
| 5,329,992 | 7/1994 | Tripp | 165/45 |

OTHER PUBLICATIONS

"Freonless Air Conditioner", article in *Mechanical Engineering,* Aug. 1973.

"Rotary Vanes Cool Air, " article in *Machine Design,* Sep. 6, 1973, pp. 45–46.

"Air Only Air Conditioner Surprises Auto Makers", article in *Machine Design,* Mar. 6, 1975, pp. 10–11.

*Primary Examiner*—Henry A. Bennett
*Assistant Examiner*—Dinnatia Doster
*Attorney, Agent, or Firm*—Catalano, Zingerman & Associates; John D. Gassett

[57] ABSTRACT

A rotary vane/expansion device having a housing, a rotor with a shaft having an axis, a plurality of telescoping vanes extending radially outwardly from the axis to rotationally contact the inner wall of the housing. There is a movable housing which rests on a track. There are two sets of drive pistons. One drives the piston (and housing) in one direction which is in a plane perpendicular to the axis of the shaft. The second drive piston drives the housing along the track in the opposite direction so that the amount of compression can be controlled. The outer edges of the vanes are provided with pin rollers to reduce wear. Telescoping vanes are also disclosed. The cross-section of the housing in a plane perpendicular to the axis has an ovoidal shape. This can also be used to obtain fresh water from salt water. Salt water is placed in a tank with heating coils in it. The tank has an overhead dome with a trough to catch condensed water. The hot compressed air is passed through the heating conduit to heat the water, causing steam to rise in a dome covering the tank. The air is passed back through the expander side, and the expanded cool air flows through the cooling panel in the dome to condense the steam, which is collected in a trough.

39 Claims, 16 Drawing Sheets

ENERGY PUMP

BACKGROUND OF THE INVENTION

This invention relates to an improved cooling and/or heating system. The air conditioning systems currently in use in many homes and in automobiles employ a two-phase refrigeration system. The components are complicated and also expensive. These systems also require an expansion valve and a number of high pressure lines and suitable fittings.

There is concern over the ozone depletion potential of many existing refrigerants. This makes it desirable to use a non-polluting, single-fluid refrigeration system such as one which uses air. Some rotor/vane compression systems for refrigeration and air conditioning using air were patented from 1969 to 1980. These were mainly single-stage unit designs for the cooling of automobiles.

In such units, the rotor has vanes which are biased outwardly so the edges contact the inner wall of the housing as the rotor is rotated. The housing is shaped such that in about one-half of a rotation the incoming air is compressed. The compressed air exits the unit and is cooled somewhat. It then re-enters the expansion side of the unit and is expanded to obtain cool air. The rotating vanes and the inner wall of the housing form chambers of continually varying size. By proper arrangement, this permits compression on one side of the unit and expansion on the other.

Some problems exist with these units related to the nature of rotary vane compressors. For rotary vane compressors to compete with existing refrigerant and air conditioning units, they must operate maintenance free for five to ten years, for example. The vane tip wear on rotary cooling and heating systems ultimately resulted in maintenance after two to three years. If precisely machined vanes were guided using bearings on rails, vane tip wear was minimized. However, these parts increased the cost of the unit. Also, when the machine heated up during operations, the tips no longer remained in contact with the housing. This caused leakage and a drop in efficiency. To my knowledge, the last attempt at a solution to this tip wear problem was described in a patent issued to Thomas C. Edwards on Dec. 30, 1980, U.S. Pat. No. 4,241,591 for a unit using amorphous carbon and magnesium parts.

The use of air as a refrigerant as a substitute for the potentially ozone damaging refrigerants presently used is highly desirable. There was an effort in the late 60's and through the 70's to produce a refrigeration system using air. However, they all had certain shortfalls, and to my knowledge no major effort has been made since then in this area. It is therefore clear that there is a need for improved or new designs for compression/expansion units which would make the use of air as a refrigerant very attractive and efficient and comparable in line to the present commercial systems using freon or other type refrigerant in the two-stage processes.

SUMMARY OF THE INVENTION

This is a rotary vane/expansion device suitable for using air for cooling or heating an enclosed space. It includes a housing having a rotor with a shaft and a plurality of vanes extending radially outwardly from the axis of the shaft to rotationally contact the inner wall of the housing.

Means are provided to move the housing with respect to the rotor. This can occur during operation of the device as when the rotor is rotating. By moving the housing, one can control the amount of compression. The more compression, the more heat transfer, and the more horsepower consumed. Therefore, I can move the housing to obtain the minimum amount of compression needed to maintain the space at room temperature, for example.

This rotor/vane expansion device having a movable housing is especially well adapted for use with a housing in which in a plane perpendicular to the axis of the vane shaft the inner wall of the housing has an ovoidal shape. The ovoid geometry will be discussed in more detail, but it includes two spaced apart arcs of circles of different diameter with the open sides facing each other and a straight line connects corresponding end points of the two arcs. This geometry inside the housing allows the vanes to be fully extended on the intake cycle to allow varying pressure output and compensates for a change of mass while still allowing full expansion on the return cycle on expansion side.

I also provide telescoping vanes with this system and the end of each vane is provided with a roller. This helps prevent leakage and lengthens the life of the rotary vane compression system.

In one system the device is operated by rotating the rotor and taking in air from a space to be cooled, and the air is compressed. The compressed air is then run through a heat exchanger of some sort, such as a coil of pipe running through the earth to cool the compressed air. One can use various heat exchangers such as air cooled, water cooled, or any other accepted heat exchanger. The cooled air is then returned to the inlet of the expansion side of the device where it is expanded and goes through an expansion air outlet where it is returned to the room which is to be cooled. Various heating and cooling uses are shown hereinafter. The compression of the air can heat it to a point at which germs, molds, etc. in the room air are killed.

This device can also be used with a desalinization unit for use in obtaining fresh water from salt water. In this system the hot compressed air from the compression side of the device is passed through a coil in salt water held in a container or tank to heat the salt water and vaporize it. A dome covers the open top of the container. The compressed air which is cooled as it goes through the coils in the salt water is returned to the expansion side of the unit where it is expanded. Then the outlet of the expanded cool air flows through a cooling panel in the top of the dome. When the rising steam contacts the cooling panel, it is condensed. The condensed steam, now water, is caught in a trough. The fresh water can be then removed and used.

An object of this invention is to provide a novel device in a variety of systems for the purposes of compressing gases, heating, cooling, ventilating, or refrigeration.

Another object is to provide a variable pressure output rotary vane compression device.

Another object is to provide a system for desalinization of salt water.

These and other objects will become more apparent when the detailed description is read in conjunction with the following drawings, in which:

DETAILED DESCRIPTION OF THE PREFERRED EMBODIMENTS

Figure 1:
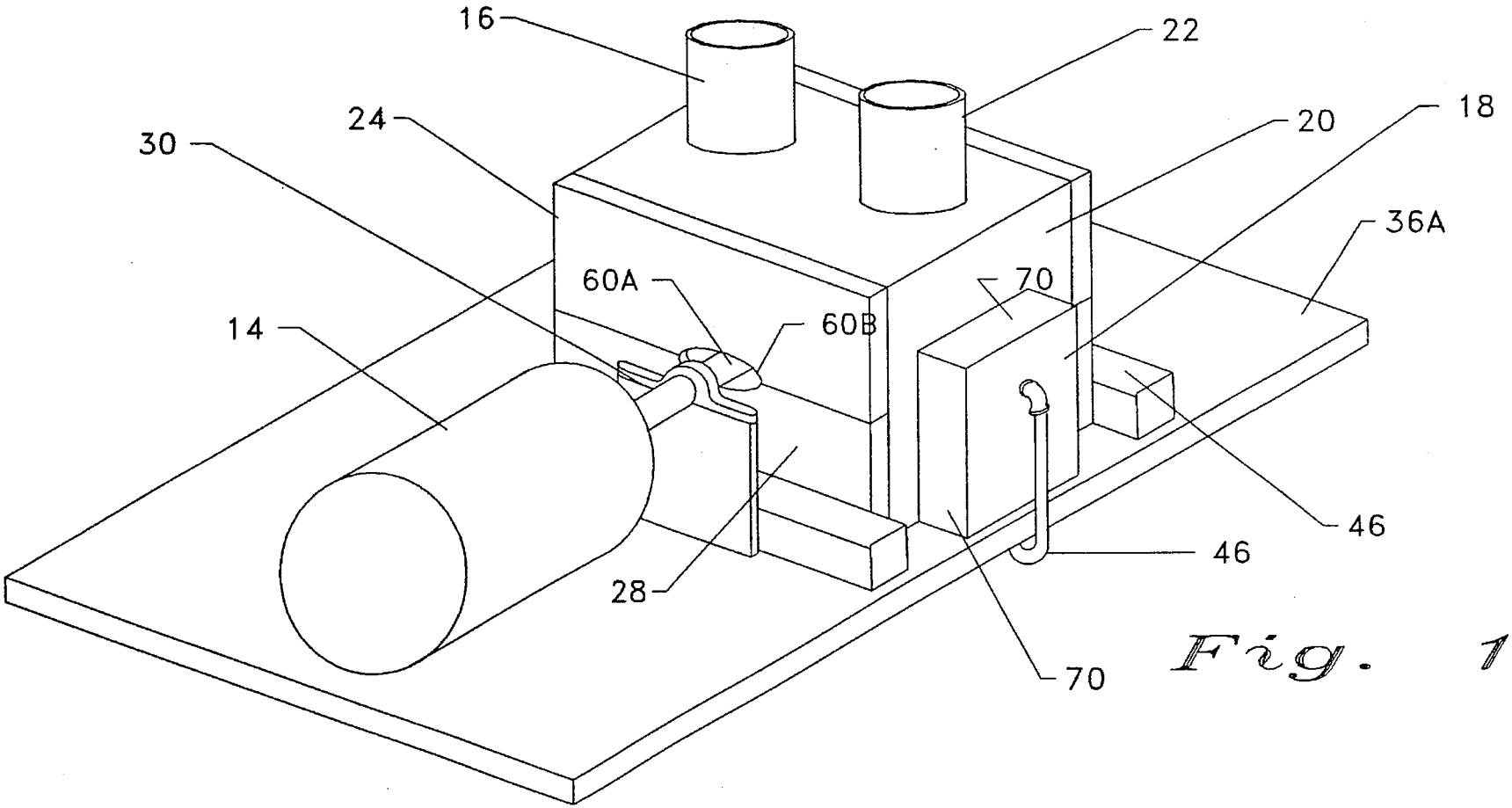
FIG. 1 is a full face isometric view showing one embodiment of the invention.
Figure 2:
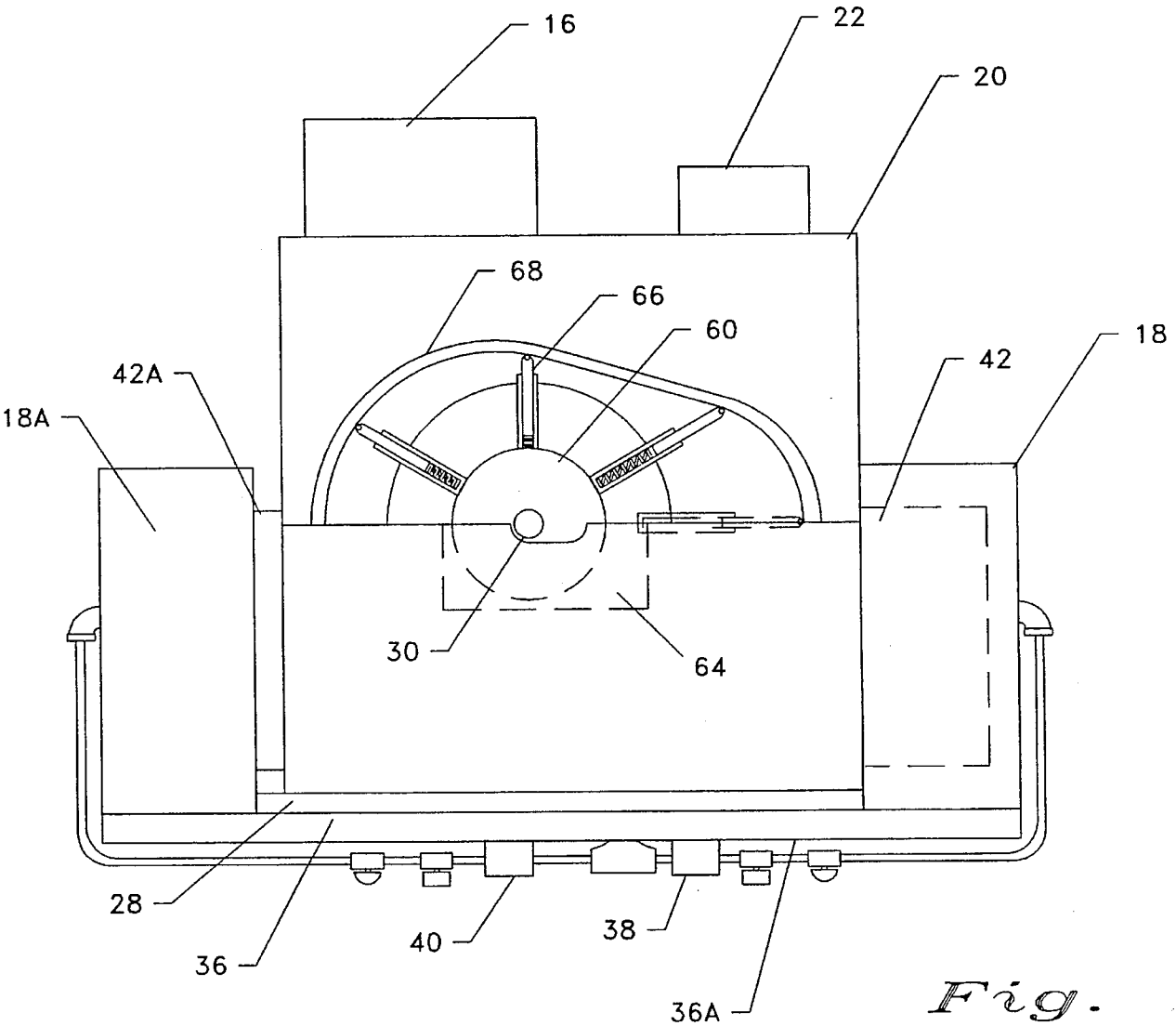
FIG. 2 is a side view of FIG. 1 with a part of the cover and drive means removed to show the top half of an inner cavity and vanes.

Attention is first directed to FIGS. 1 and 2 which show a compressor/expander unit for use in air conditioning and heating. It has a housing 20 including a chamber or cavity of generally ovoidal cross-section, a compressor side, and an expander side. The compressor side has a main inlet 16 and a secondary or compressed air outlet 40. The expander side has a secondary or compressed air inlet 38 and an expanded air outlet 22. On the expander side is a piston housing 18 having piston 42 useful for driving the housing with respect to the shaft 30 of the interior rotor 62 in the direction looking at the drawing to the left. On the compressor side is a complementing piston housing 18A having a piston 42A which is adapted to drive the housing with respect to the shaft in the direction 180° from that direction driven by piston 42. The purpose of this will be explained later. A driver unit 14 turns shaft 30 which turns the rotor within the housing to provide for the compression and expansion of the fluid which would normally be air.

Attention is next directed especially to FIG. 2. Shown thereon is a rotor 62 having a rotor shaft 30. The direction of movement of the pistons 42 and 42A is perpendicular to the axis of shaft 30. A plurality of sliding vanes 66 extend outwardly through slots in rotor 62 to form a plurality of varying volume chambers 66A. As mentioned above, the housing is slidable with respect to the rotor. This includes a housing guide 36 which may be a rail, etc. along which the housing slides when either piston 18 or 18A is activated. The housing guide 36 is supported by frame 36A which supports the unit. The housing moves with respect to the shaft 30 which extends therethrough.

Figure 12:
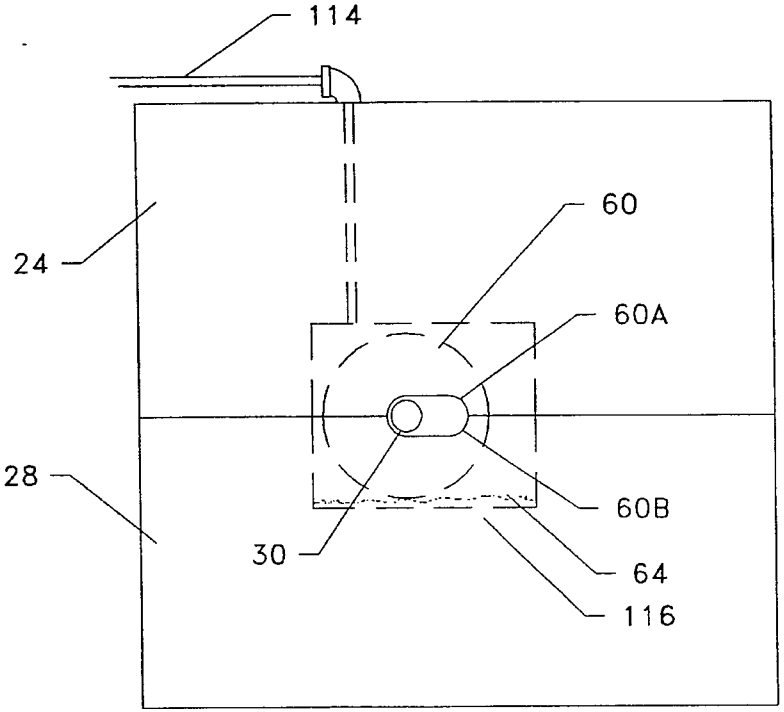
FIG. 12 is a view of the seal taken perpendicular to the axis of the shaft of the rotor.
Figure 11:
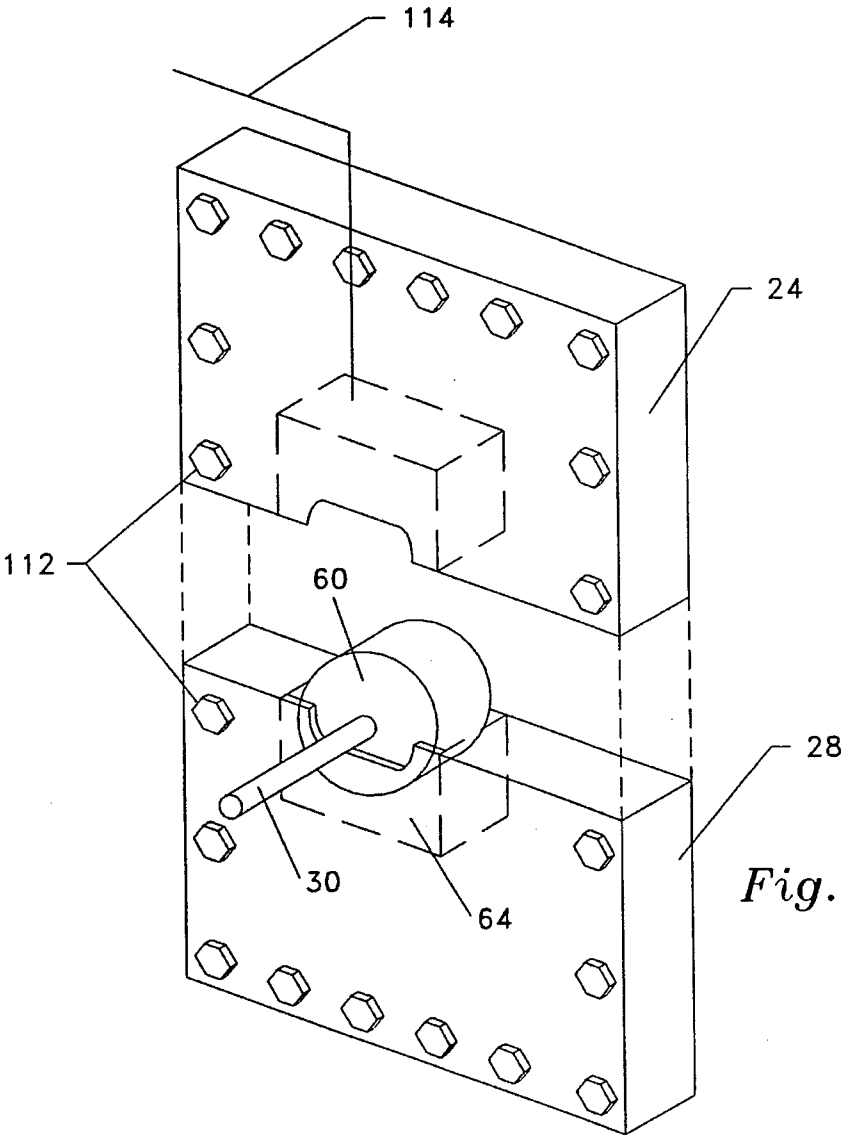
FIG. 11 is an isometric view illustrating a movable, positionable seal in the side of the housing through which the shaft of a rotor extends.

I have provided a movable positionable seal 60 which is explained in greater detail in conjunction with FIGS. 11 and 12. There is shown a top half side cover 24 and a bottom half side cover 28. There is a trailer seal slide track 64 which is made of a slot 60A in top half side cover 24 and a slot 60B in the top of the bottom half side cover 28. Seal 60, in one embodiment, is a solid disc or cylindrical object which may be plastic and which is fixed to shaft 30 and rotates with it. There is close clearance between disc 60 and the top and bottom of slots 60A and 60B respectively. This close tolerance prevents excessive loss of air from within the housing which normally will not have a pressure more than 20 psi more than the outside air. As shown in FIG. 12, water can be added from water supply line 114 to the interior of slots 60A and 60B to have a level 116. This lubricates the seal and slows down leakage of air past the seal. Shaft 30 is supported above support frame 36A by support frame 32 as shown in FIG. 1. When the housing is moved with respect to the shaft, seal 60 slides along in slide track 64. There is a similar seal on the other end of shaft 30 such that the shaft remains supported even during movement of the housing.

Figure 3:
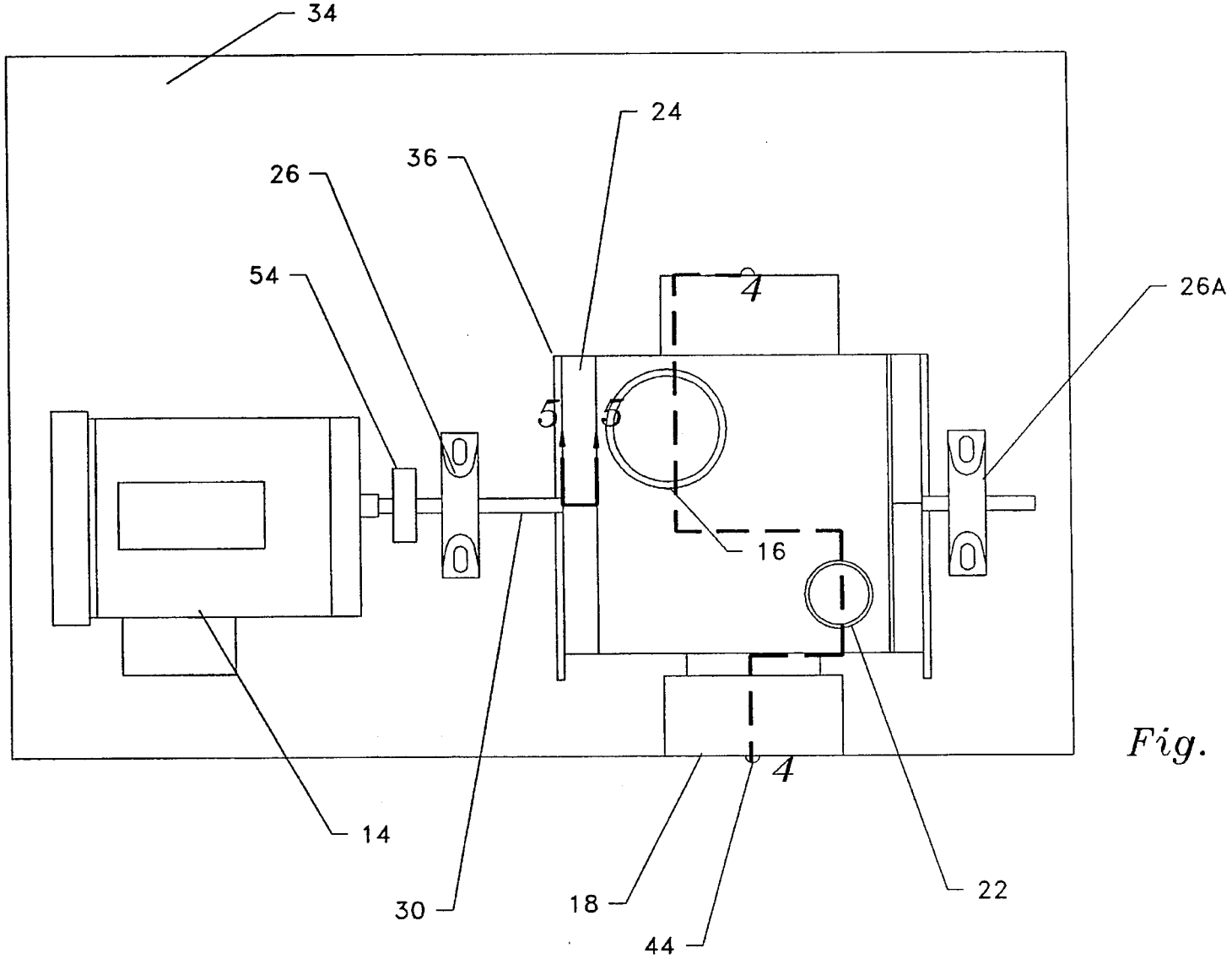
FIG. 3 is a top view of the device of FIG. 1.

FIG. 3 is a top view of the device of FIG. 2 and shows the inlet 16 and return of expanded air outlet 22 which shows that the shaft is supported by pillow block shaft bearings 26 and 26A. A coupling 54 connects the output of motor 14 to the shaft 30 of the unit. Details of the sliding seal 60 is omitted in this Figure.

Figure 4:
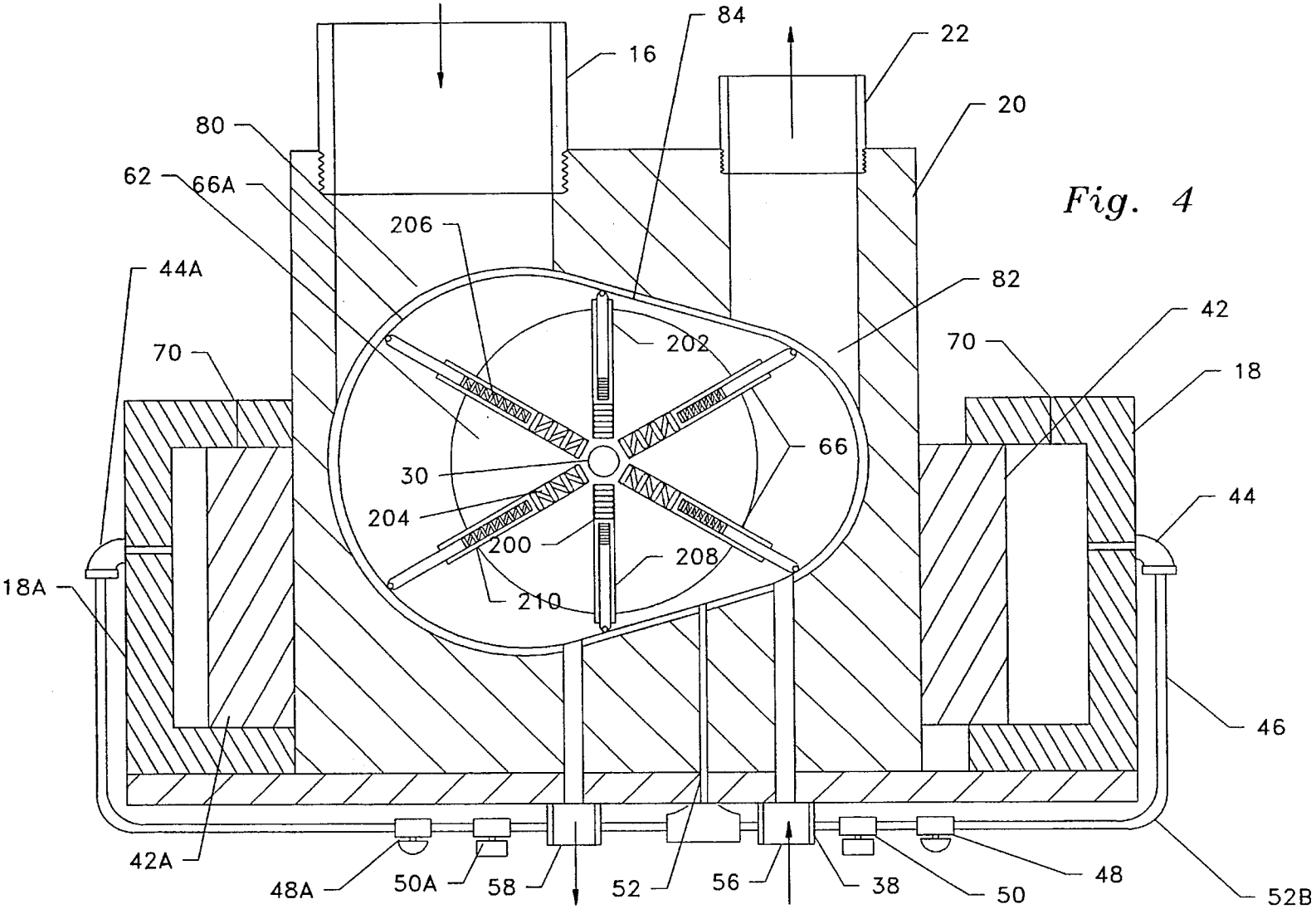
FIG. 4 is a view taken along the line 4—4 of FIG. 3.
Figure 5:
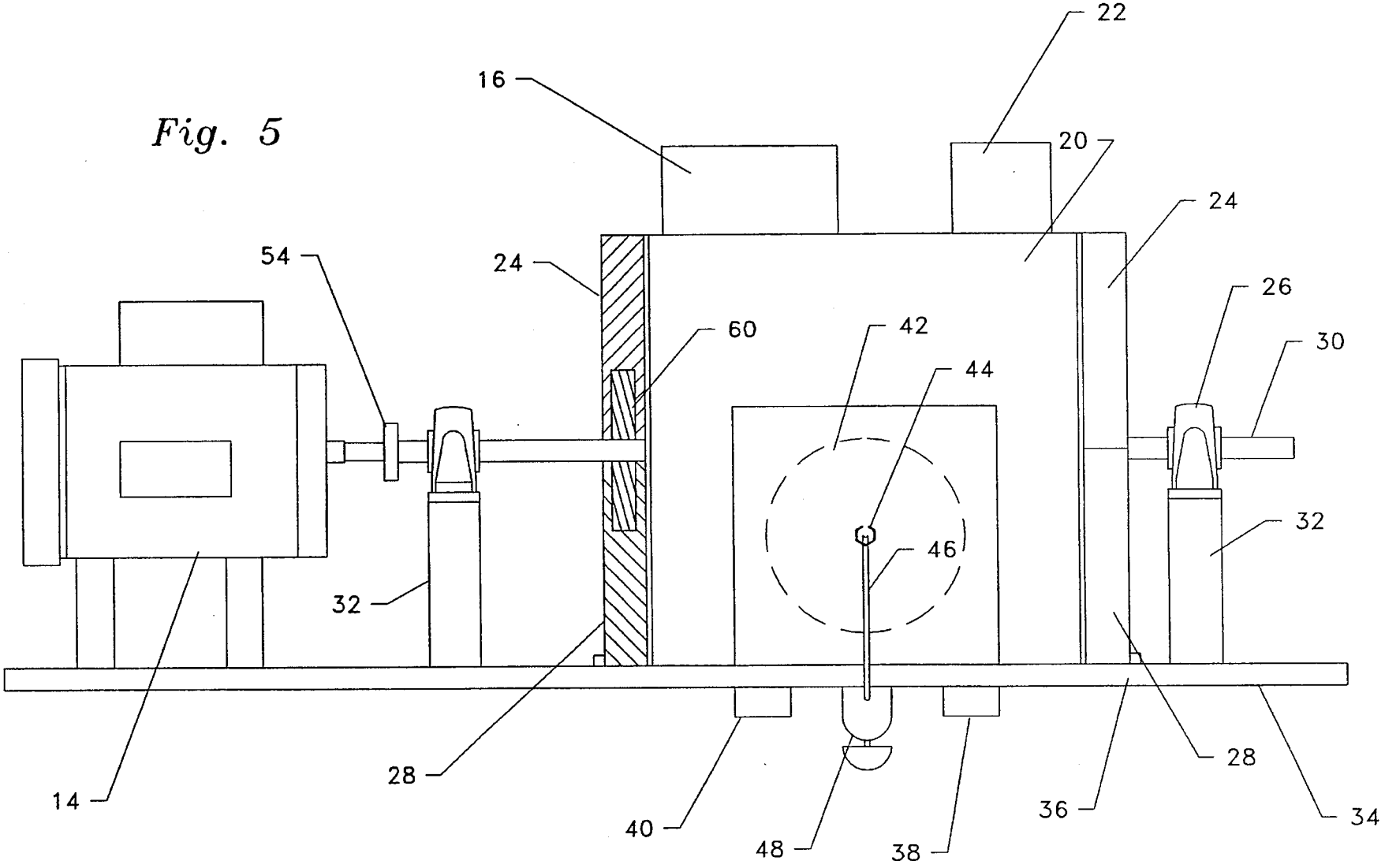
FIG. 5 is a side view of the embodiment of FIG. 1 with a partial view along the line 5—5 of FIG. 3.
Figure 9:
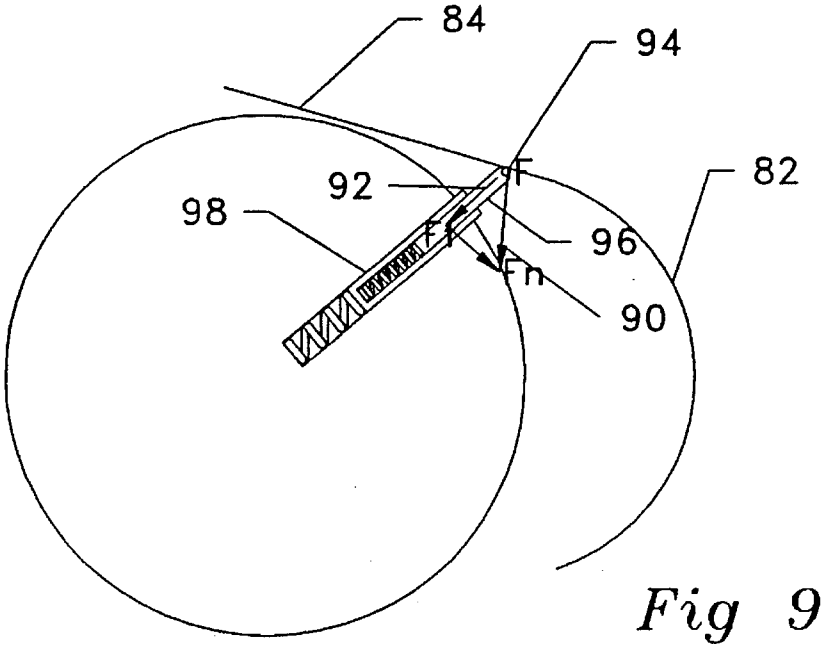
FIG. 9 illustrates the geometry showing the angle of the rotor vane in a line perpendicular to the interior of the housing and also illustrates a roller bearing at the end of the vane.
Figure 10:
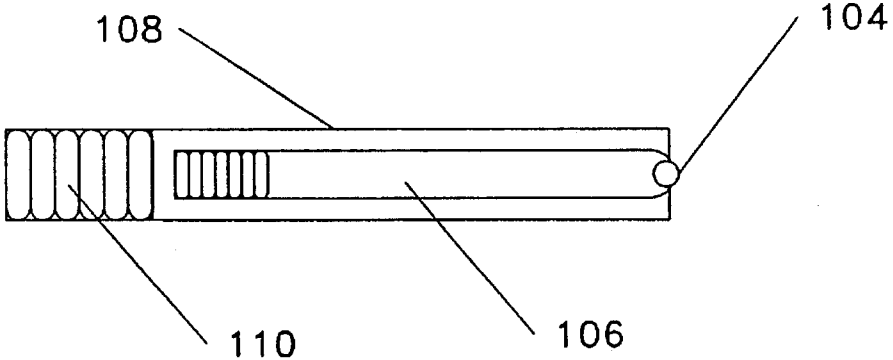
FIG. 10 illustrates the telescoping of one extension vane in the slot of another vane.

Attention is next directed to FIG. 4 which is a view taken along the lines 4—4 of FIG. 3. This shows a plurality of sliding vanes 66 which are supported within slots 200 of the rotor. These vanes, as also shown in FIGS. 9 and 10, in accordance with one embodiment of the present invention, are telescoping type. A first section 202 of the vane is in slot 200 of the rotor. This section is forced outwardly, for example, by springs 204 and/or centrifugal force. Vane 202 is in turn provided with a slot 206 which holds sliding vanes 208 which are biased outwardly by spring 210. These telescoping vanes are shown more clearly in FIGS. 9 and 10.

Shown in FIG. 9 is a primary vane 98 which moves in and out of the slot in the rotor. A secondary vane 96 is slidable telescopically in the slot within the primary vane 98. The end of secondary vane 96 is provided with a vane needle bearing 94. The bearing 94 rolls along the inner surface of the housing. This bearing reduces friction between the vane and inner wall of the housing. Line 84 is a straight line which represents the connection between one arc 82 and a second arc 80 shown in FIG. 7.

Line 90 is the line perpendicular to the housing at the point of intersection of the roller 94 and the inner wall of the housing, and represents the force F. Line 92 is a vane force tangent line $F_t$. The force $F_t$ is the force from the wall through the tangent point parallel to the vane. It is the force pushing the vane towards the rotor shaft. The angle $\Theta$ defines the angle between lines 92 and 90. $F_t$ and $F_n$ are the tangential and normal components of the force F. Kinematics and Dynamics of Machines (McGraw-Hill 1969, 1987, p. 216, FIG. 10–13) recommends that for prior shaped housings that the angle between F and $F_t$ not exceed 30°: This relationship should apply whether or not the end edge of the vane has a roller bearing and/or a cross-sectional ovoidal cross-sectional configuration of the housing as I disclose herein. The point being made in the comparison of $F_t$ and $F_n$ and F is that there is a minimum ratio between the two radii of the two arcs. If the smaller of the two arcs is too small, then the normal force on the vane will be too great. This angle $\Theta$ just discussed defines a criteria for analyzing the ovoid shapes described herein as a part of this invention to ensure the vanes will not be overstressed.

In FIG. 10 there is shown in enlarged portion the secondary vane 106 within a slot within primary vane 108. A spring 110 is shown within the slot within primary vane 108 to urge secondary vane 106 outwardly. At the end of secondary vane 110 is a vane needle bearing 104 which rolls along the inner wall of the housing. The use of this roller on the end of the vane extends the life of the units and makes them equal in reliability to existing refrigeration methods. It is anticipated that in the preferred embodiment a liner or sleeve will be provided in the housing and the sleeve will have a contour which is as described herein in regard to FIGS. 6, 7, and 8. In most cases, where temperatures do not climb above 300° F., the sleeving may be of a thermoplastic. In applications where the temperature will be relatively high, the sleeving should be ceramic. In the thermoplastic sleeve design, it is intended that the roller will sink slightly into the sleeve or liner, aiding the seal between the vanes while reducing the wear on the roller. In the high temperature design, the roller may be slightly deformed at high temperatures. This may accelerate fatigue in the roller. However, the roller is easily removed and replaced for harsh service applications. The roller may be of various materials such as plastic or metal, such as stainless steel. The use of these pin rollers will increase the operating life of the vanes due to less wear and fatigue, and when worn its rollers can be readily replaced.

There are two pneumatic systems of moving the housing with respect to the rotor described in this application. One method opens and closes solenoids supplying pressurized air to pistons in opposite sides of the housings. The solenoids are controlled electrically. One such system is shown in FIG. 4. In a second system the position of the housing is controlled by temperature sensing bulbs which open or close the solenoid valves based on room temperature. This is discussed in relation to FIG. 22. However, a variety of mechanisms can be used to control the housing position. For example, levers, cables, pneumatic and electronic devices, magnetic coils or jackscrews can be used to position the housing. The use of flexible connectors between the air conduits and the inlets and outlets of the housing permits movement between the housing in relation to the rotor.

I will now discuss a means shown in FIG. 4 for driving the housing 50 along track guide 36. A piston pressure tap 52 is connected into the interior of housing liner 68. Pressure tap 52 is connected to conduits 52A and 52B. Conduit 52A conveys power fluid to inlet 44A. Conduit 52B connects to the power side inlet 44 of piston 42. Conduit section 52A is provided with a regulator 48A and a solenoid valve 50A. Likewise, conduit 52B is provided with solenoid 50 and a regulator 48. The regulators, of course, are used to ensure that the downstream pressure is the proper pressure for operating the pistons 42 or 42A. The solenoids 48A and 48 are driven to open or close, depending upon whether it is desired to move the housing to the left or right in relation to the rotor 62. These solenoids can be controlled manually or by a thermostat which can be set to drive it one direction so that peak load or compression of maximum body of air will occur, such as when a house is just starting to be cooled or can drive the housing in the other direction in order to conserve the amount of horsepower being used. In the device in the position shown in FIG. 4 when piston 42 is in that portion, vent 70 in the wall of the piston housing is opened, and the pressure in the piston housing, when solenoid valve 50 is closed, is slowly relieved to the atmospheric pressure. Other means of relieving the pressure in the piston housing may be used. Then when force is applied to piston 42A on the other side, the housing can be moved rather easily. Piston housing 18A also has a port 70 to serve the same purpose. This feature of moving the housing in relation to the rotor permits the selection of selected pressure outlet rotary vane compression which optimizes the use of horsepower in cooling and reduces high pressure side fluid temperature. The geometry of the cross-section of the compartment within the housing will be discussed in greater detail in regard to FIGS. 6, 7, and 8.

Figure 6:
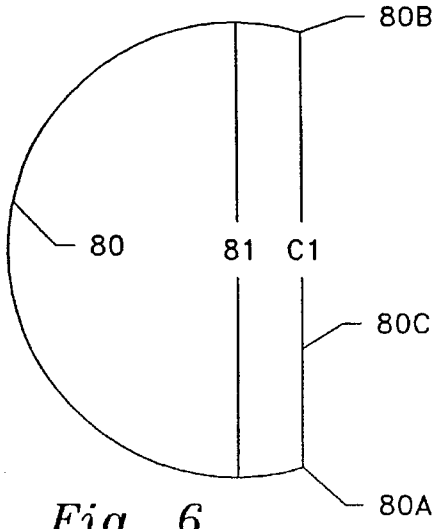
FIGS. 6, 7, and 8 show geometry of the preferred shape of the cross-section of the interior of the housing taken in a plane perpendicular to the axis of the rotor.
Figure 6:
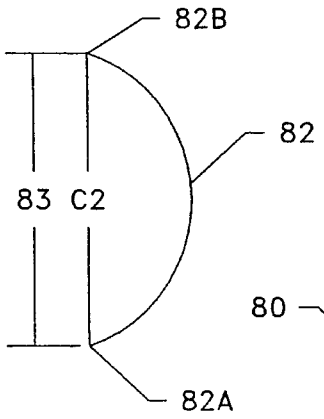
Figure 8:
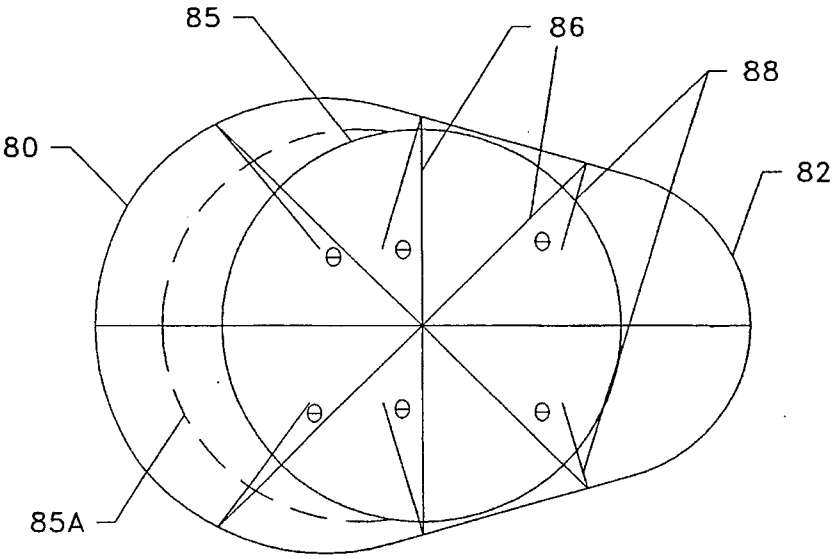
Figure 7:
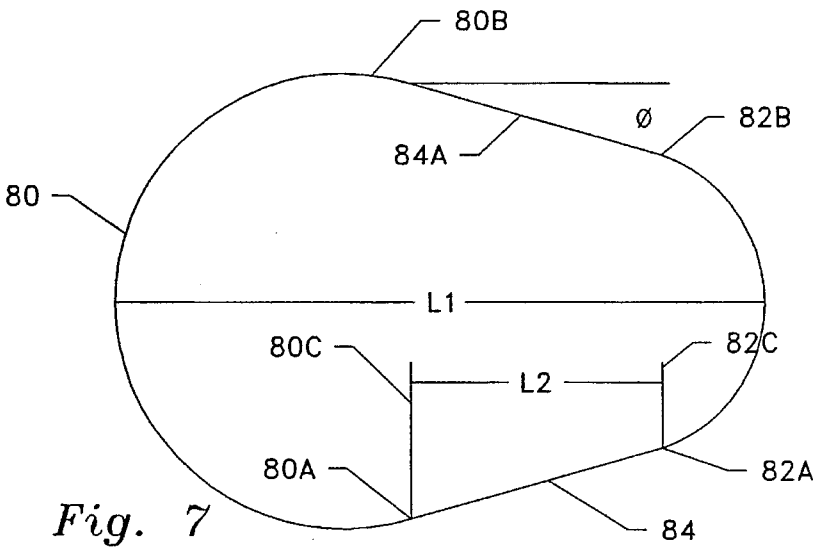

Attention is next directed to FIGS. 6, 7, and 8 to discuss the geometry of the preferred cross-section of the inner wall of the housing or compartment in which the rotor rotates. The shape of the cross-section may be generally characterized as ovoidal and includes two spaced apart arcs such as shown with straight lines connecting the end points. Shown in FIGS. 6, 7, and 8 are the large arc 80 of a circle having a diameter $D_1$ and a center at 81. The arc preferably extends for about 214°, but typically may range from 180° to 245°. $C_1$ is the straight line distance between the ends 80A and 80B of arc 80. On the right-hand side of FIG. 6 is a second or smaller arc 82 which extends from point 82A to 82B. This arc 82 has a center at 83 and has a diameter $D_2$ which is less than $D_1$. The distance between points 82A and 82B is $C_2$. Arc 82 preferably extends about 142° but typically may be in the range of about 90° to 165°. The arcs open toward each other.

In one typical design, the large-to-small arc ratio, that is $D_1$ to $D_2$, is 1.472, and the large arc-to-rotor diameter ratio is 1.222. In this example the rotor diameter to small arc diameter ratio is 1.204. The length of the shape, from the midpoint of the large arc to the midpoint of the small arc is designated $L_1$ as shown in FIG. 7. $L_1$ is typically 2.846 times the large arc diameter $D_1$ in this typical design example. Dashed circle 85A shows the position of the rotor moved to the expander mode. Solid line 85 is the position of the rotor during maximum compression.

Attention is next directed especially to FIG. 7 in which the two partial circles have been connected by a straight line 84A from point 80B to 82B. A second straight line 84 connects point 80A with point 82A. The length from the center arc 80 to the center of arc 82 is designed $L_1$. The distance between lines 80C and 82C is designated $L_2$. Straight line 84A makes an angle $\emptyset$ with the horizontal on a line parallel to $L_1$.

FIG. 7 shows generally the preferred shape of the cross-section of the inner wall of the housing taken along a plane perpendicular to the axis of the rotor shaft.

FIG. 8 is similar to FIG. 7 except that circle 85 has been added to indicate the rotor. In this design, preferably the angle ⊖ of the perpendicular of the perimeter of the configuration of FIG. 7 and the vane is less than 30° for all vanes for all rotational positions of the rotor. If the angle ⊖ of the perpendicular of the perimeter and the vane is much greater than 30°, the force $F_n$ that the wall places on the vane will eventually bend and break the vane. It is good cam follower design not to allow that angle ⊖ to be much greater than 30°.

The dashed circle 85A represents the position of the rotor when starting the unit. The compression is small here so a smaller motor can be used than that required if the housing were not movable. After speed is obtained, the housing can be moved so the rotor is roughly in the position of solid line circle 85.

Providing means for moving the housing in relation to the rotor means that the unit 21 can have multifaceted uses. It allows the same device to operate as heating, ventilation, air conditioning, or refrigeration unit (HVACR) (FIGS. 13, 14) or as a Brayton Cycle Engine (FIG. 14). It also reduces (or increases, as desired) the pressure differential between the inlet from the space being cooled and the outlet to the heat exchanger, allowing the unit to respond to widely varying loads with an efficient use of horsepower.

In all modes and methods of heating and cooling, the amount of heat transferred into or out of the space is a function of the compression/expansion process. The more compression, the more heat transfer. In addition, horsepower consumed is a function of compression. Therefore, only the minimum amount of compression should be used to maintain a room space temperature. Because of this, a variable compression feature is desired on the unit to minimize driver sizing and horsepower consumed. I disclose such a system.

Figure 22:
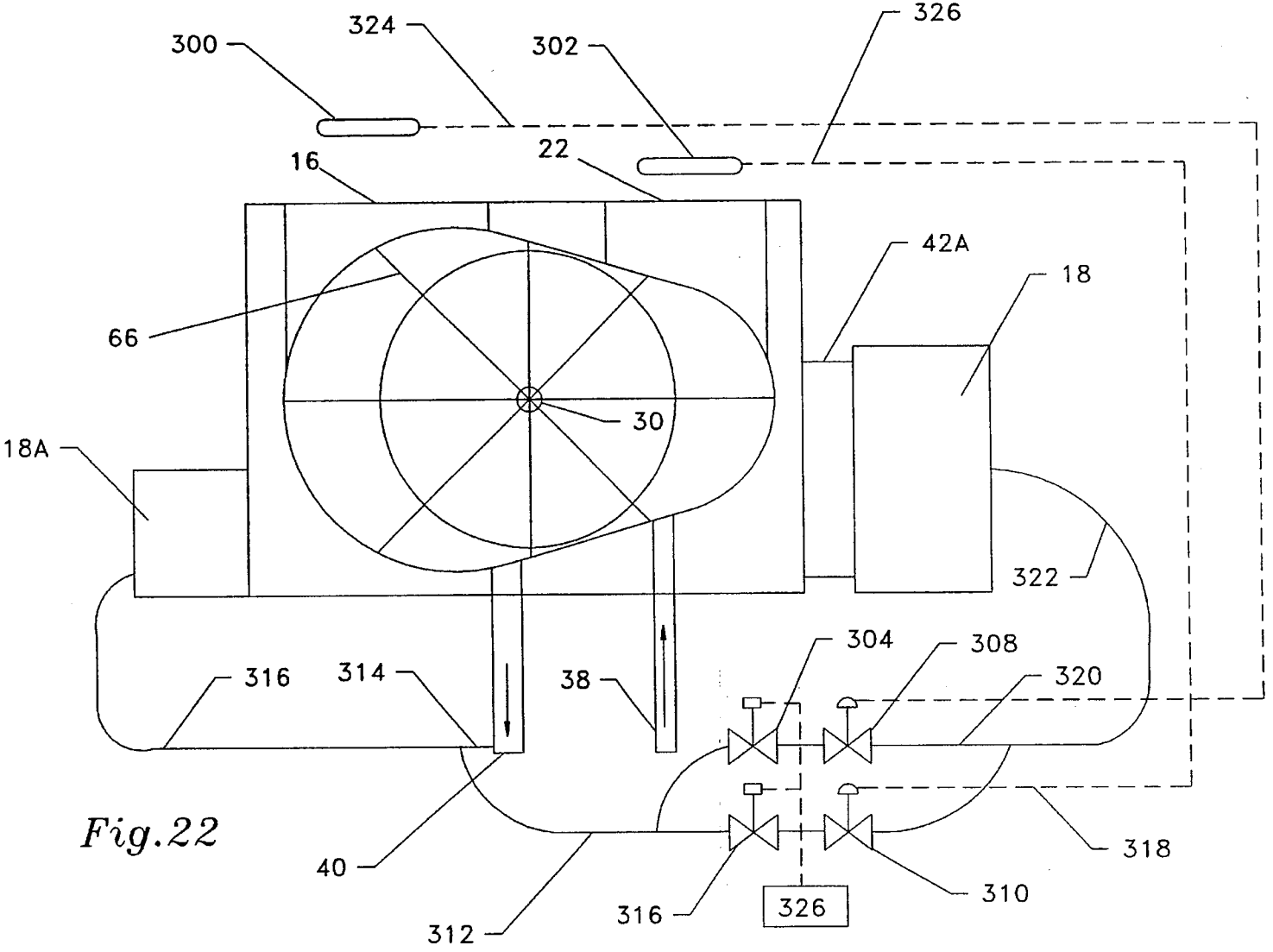
FIG. 22 is a schematic view of means for controlling the position of the housing with respect to the rotor.

Attention is next directed to FIG. 22 which shows schematically a system to control the heating and cooling of a room, for example. This is similar to the FIG. 2 except that it is more schematic and includes more control features. This schematic control system can be used for either heating or cooling a room, for example. It includes a first temperature sensitive bulb or means 300 and a second temperature sensitive bulb or means 302. Bulb 300 is in the path of the inlet air from the room to be heated or cooled. Temperature sensing means 302 senses the temperature from the outlet 22.

There is provided a first piston housing 18 with piston 42A which when energized moves the housing to the left with respect to the drawing. A second piston 18A when energized forces the housing in the opposite direction with respect to the rotor. The piston 18A has considerably less area exposed to power fluid than that of the piston 42A. I will now discuss the flow diagram of the pressurized air which is used for controlling these pistons 18 and 18A. A pressure air takeoff 314 is provided in outlet 40. It has a first air conduit branch 316 which connects to the power side of power piston 18A. It has a second air conduit branch 312 which in turn has conduit branches 318 and 320.

In branch 320 in series is a solenoid valve 304 and a control valve 308. Solenoid valve 304 is a normally closed valve, that is, when no electrical energy is supplied to it, it is closed. Valve 308 is a reverse acting control valve which is controlled by temperature sensing bulb 300 which is near the inlet to unit inlet 16. If the room is cold, i.e., below a selected value such as 65°, the gas in the bulb contracts, the pressure in conduit 324 drops, and valve 308 is opened. As the temperature on temperature sensitive means 300 rises, the control fluid in conduit 324 rises in pressure and starts valve 308 closing until it becomes fully closed with increased temperature. When the unit is used for heating, solenoid valve 304 and control valve 308 are used. As will be seen, during the heating mode solenoid valve 306 in line 318 and control valve 310 are inoperative, that is, valve 306 is closed.

During the heating phase when the incoming air acting on bulb 300 is colder, valve 308 is open, and the power pressure air will act on piston 18. Piston 18, being larger than piston 18A, will drive the housing to the left so that it is in the position shown in FIG. 22. When in this position, the compression is at its highest. This will increase the heat added to the cycle. However, in time, as temperature rises, valve 304 remains open, but valve 308 which is a normally open valve, will start closing.

As the temperature in inlet air rises, valve 308 will start closing. When it becomes fully closed, the air pressure to piston 18 is reduced to essentially zero as pressure air escapes through vent 70, and the pressure on piston 18A will drive that piston such that the housing is moved to the point where the rotor 30 will be toward the left side to a position indicated by dashed line 85A in FIG. 8, and there will be less compression of air. With less compression, that means less heating of the air. This is what is desirable inasmuch as when the room gets to a selected temperature, the amount of heating needed will be less. As the temperature starts to decrease, valve 308 will start to open, which will direct air pressure on piston 18 to move the housing back to the position in FIG. 22 which, in effect, increases the compression of the air entering inlet 16. When in the heating mode, energization of the unit opens solenoid valve 304. Bulb 300, or equivalent, may be selected so it can be set so that at a first temperature valve 308 is closed and at a second higher temperature it is open. Systems for opening and closing valves in response to temperature are well known.

When the device is desired to be used as a cooling system, solenoid valve 304 is closed, thus effectively removing valves 304 and 308 from operational control. Solenoid valve 304 and control valve 308 are used when it is desired to add heat; but when it is desired to cool the air, solenoid valve 306 and control valve 310 are used. When in this cooling mode solenoid valve 306 is opened by application of electrical energy. Valve 310 is a normally closed valve. That is, when no outside force is acting upon it, it is closed. The outlet temperature sensor 302 senses the temperature of the air coming out of outlet 22. This is conveyed through conduit 326 to valve 310. Any method of using the sensed temperature at 302 can be used to convey a control signal to control valve 310. However, a conduit 326 containing a control fluid which expands and contracts in response to the sensed temperature is very convenient to use. If the air is cool to a selected temperature, the valve 310 will close in response to the reduced pressure signal from bulb 302, and the housing and rotor will move to the position of 85A in FIG. 8 so that there is a minimum of compression. However, as the air temperature increases at the outlet the fluid pressure in conduit 326 increases and causes valve 310 to start to open. During this time solenoid valve 306 is open; and as valve 310 opens, high pressure air applied to piston 18 is as high as that applied to piston 18A. As piston 18 is larger than piston 18A it will drive the housing to the position shown in FIG. 22. Thus there will be more compression and more cooling of the air.

To briefly recapitulate, as the outlet air at 22 starts cooling, the decreased pressure in conduit 326 from sensor 302 will cause the valve 310 to start closing as it is a normally closed valve. When the outlet temperature at 22 gets higher, increased fluid pressure in conduit 326 will cause valve 310 to change from normally closed to open.

When this happens, the piston 18 drives the housing to the position shown in the drawing, and there will be more cooling because of the higher compression. So when the temperature becomes cooler on the outlet 22, the valve 318 will start to close; and when it closes, the piston 18A will drive the housing to the right with respect to the housing, and there will be less compression. As the temperature gets closer to the desired temperature, less compression is needed, so there is a saving in energy.

In order to have the device start without load when it first starts out, it is desired to position the housing to the right with respect to the rotor so that there is only a small amount of compression. This will permit the use of a smaller drive motor than otherwise. This delay can be easily accomplished by having a timer circuit 326 which is activated by a signal from the turn on-off switch for the unit which is operated by a thermostat. The same thermostat that turns the unit off and on controls a timer circuit 326. The output signals from the timer circuit 326 are conveyed to solenoid valves 304 and 306 to override the other controls and keep them closed for a selected time, e.g. three to five seconds, which time would be selected to be adequate to get the rotor up to full speed before the controls start positioning the housing with respect to the rotor in response to the temperature which is being controlled.

There are two timing sequences in the operation of the control system of the unit of FIG. 22. One occurs at startup and the other at shut down. Various known timing control techniques may be used. For example, on startup a capacitor in a timing circuit holds the signal to the solenoids so that both stay closed until the unit reaches full speed. Once full speed is reached, the cooling or heating solenoid (304 or 306) is opened depending on the mode the system is in. In one convenient control system the speed of the motor doesn't determine when the solenoids are opened. Full speed is reached in two or three seconds; and at the end of the selected time of two or three seconds, a control signal is transmitted to the solenoids.

A general statement or explanation of shut down of the unit follows. A second timer circuit kicks in when the thermostat reaches a selected temperature. It starts a "shut down" cycle, and the power to the unit is turned off. When an "off circuit trip switch" senses this turn-off signal, both solenoids are closed, and the unit runs five to ten seconds longer, shoving the housing to the right, then shutting off.

Another switch closes solenoid 306 when the air is to be used for heating and permits 304 to be open; and when used for cooling, solenoid valve 306 is open, and solenoid valve 304 is closed. In other words, it is connected so that solenoid 304 and control 308 is used for heating, and solenoid valve 306 and control valve 310 are used for cooling. Then when valve 304 is open, valve 306 is closed; and when valve 306 is open, valve 304 is closed. A skilled instrument engineer can readily implement the control functions relating to the system of FIG. 22.

Figure 23:
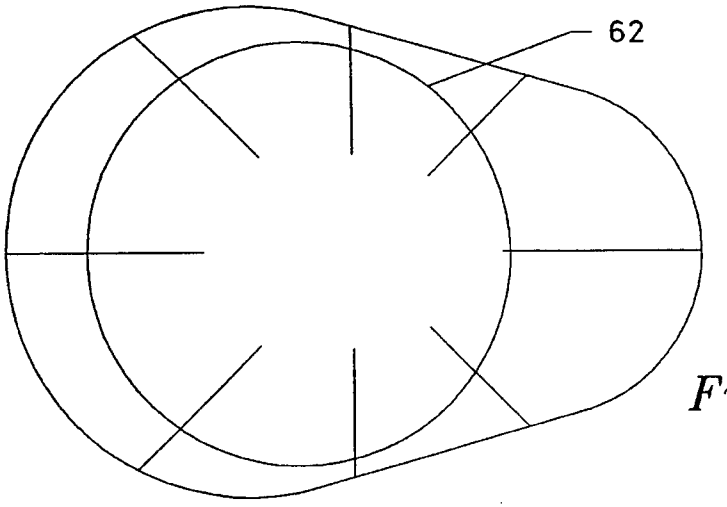
FIG. 23 illustrates the start position of the housing and rotor in the schematic of FIG. 22.
Figure 24:
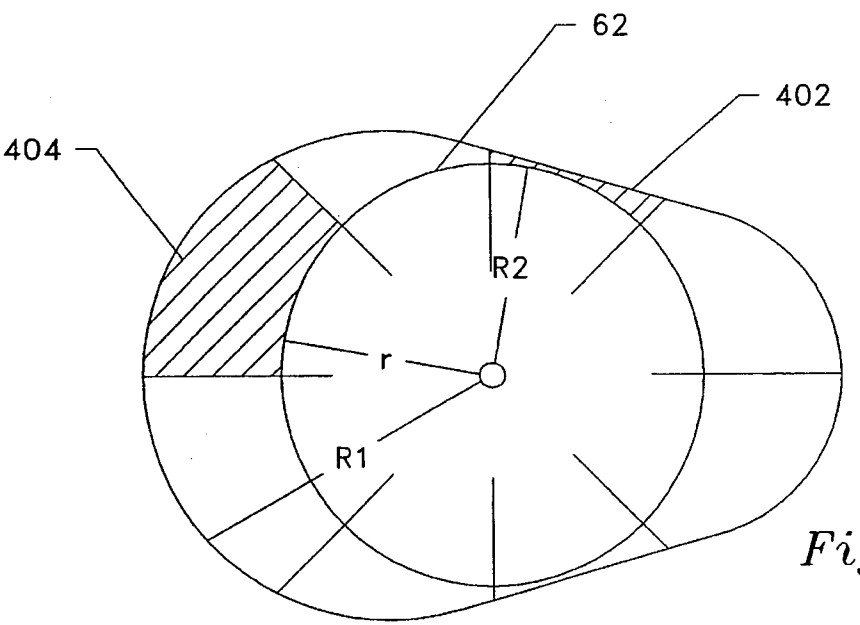
FIG. 24 shows the position of the rotor with respect to the housing for maximum compression and also symbols used in the design example.

Attention is next directed to FIG. 23 which shows that at the start position the rotor 62 is near the center of the arc of the large circle. This allows the unit to start in an unloaded position. Thus the size of the motor can be minimized.

The regulator valves shown in FIG. 22 control the position of the housing in relation to the rotor. Solenoid switch 304 opens after a short time delay from startup to permit the unit to reach full speed. FIGS. 2, 3, and 4 show a method of controlling housing position by having a thermostat, not shown, open and close solenoids 50 and 50A and controlling the pressure to the piston using pressure regulators. FIG. 22 displays a second possible method. Other schemes may be used. In all cases the unit would start in an unloaded position and adjust to full pressure, then return to the unloaded position on shutoff.

Figure 13:
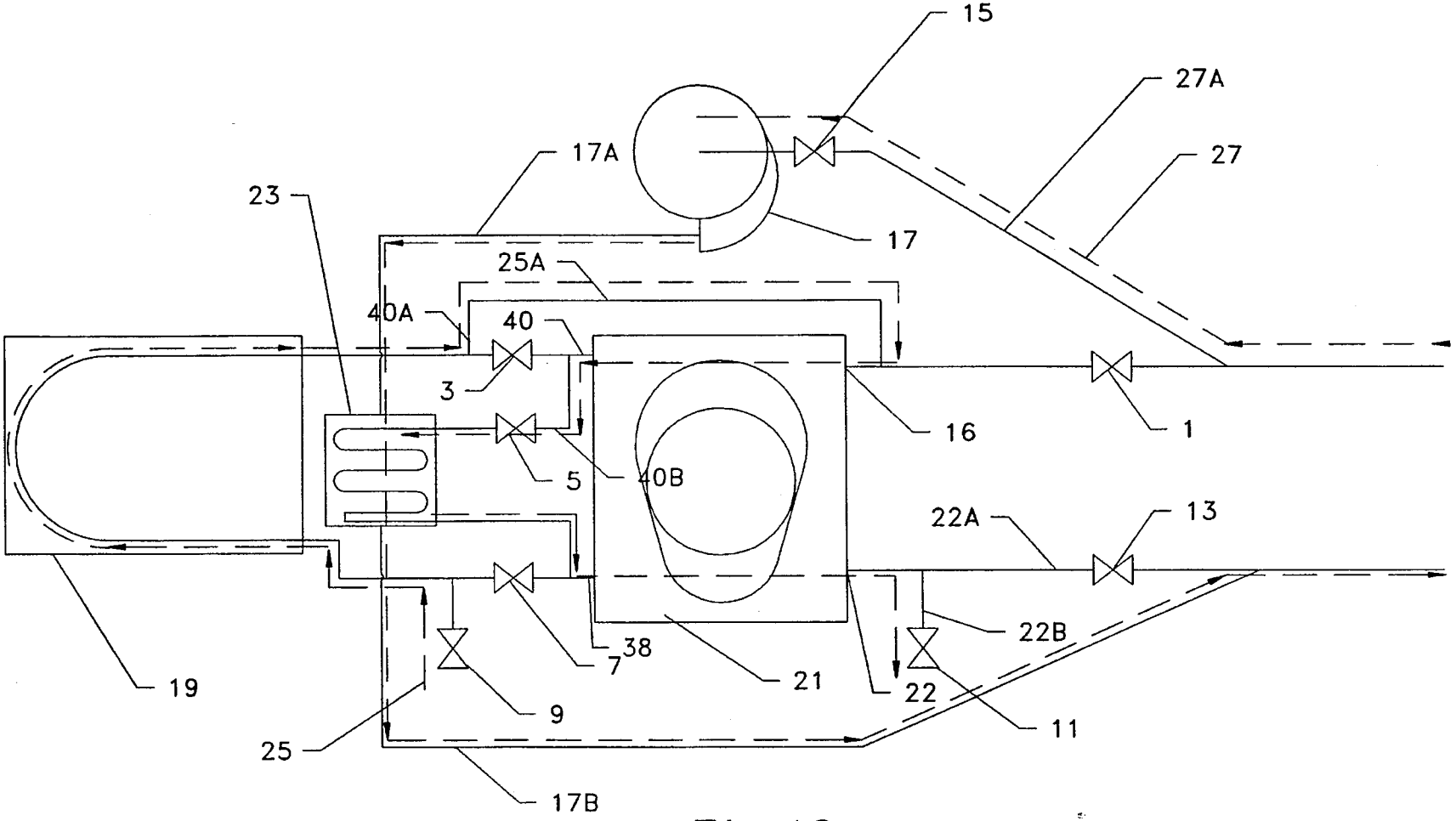
FIG. 13 is a schematic of a heating and cooling system using only electricity as a means of moving energy.
Figure 14:
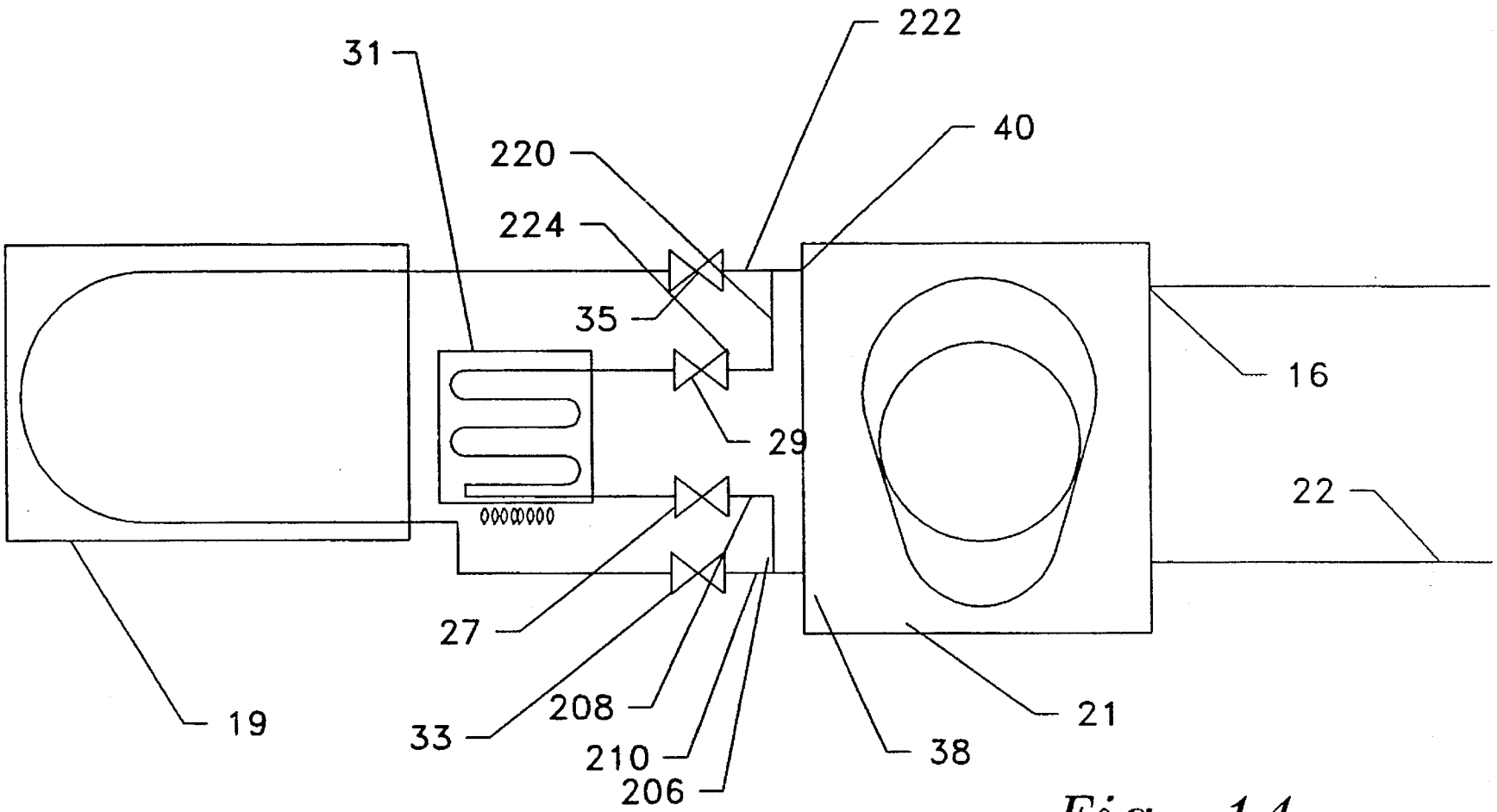
FIG. 14 is a schematic showing a system that can be used for cooling and uses the combustion of a fuel for heating.

Attention is next directed to FIG. 13 which shows a schematic flow diagram of a system which can be used for either heating or cooling a home, for example. Shown thereon is the compression/expansion unit 21 which has an air inlet 16, a compressed air outlet 40, a secondary inlet 38, and an expanded air outlet 22. The compression side of unit 21 has compressed air outlet 40 which has two branches, 40A and 40B, having valves 3 and 5 respectively. Branch 40B goes through heat exchanger 23 and returns to secondary inlet valve 38 to the expander side of the compressor/expansion unit 21. The outlet 22 has two branches 22A and 22B which has valves 13 and 11 respectively. The outlet valve 13 is connected to the conduit 22A which goes to the area being heated or cooled. Valve 11 when open permits air to return to the outside.

A conduit 27A is open at one end to the room to be heated and is connected through valve 15 to squirrel cage fan 17. The outlet of fan 17 is connected to conduit 17A and is connected to heat heating coils within heat exchanger 23 and on downstream side connects to conduit 17B when returns to the room being heated.

In the heating mode, valves 1, 13, 3, and 7 are closed and valves 9, 5, 11, and 15 are open. Outside air enters through valve 9, flow through ground coil 19, and returns to conduit 25A into the intake 16 of the compression/expansion unit 21 where the air is compressed. It then flows through conduit 40B, through valve 5, through the heat exchanger 23, it returns through the expansion side inlet 38 and exits unit 21 at 22. The air then flows through valve 11 and is dumped to the outside of the house being heated. During this time, valve 15 is open, and room air flows through line 27A through the valve 15 to squirrel cage 17. The air for this comes from inside the room being heated. The air then flows over through the heat exchangers 23, warming the inside air and then discharging the warmed air back into the room or space being heated. The heat exchanger 23 gets its heat from the hot compressed air from outlet 40. The compressed air depleted of its heat is expanded and dumped outside through valve 11.

The system configuration as shown in FIG. 13 can also be used to cool the room air. In this case, valves 15, 5, 9, and 11 are closed, and valves 1, 13, 3, and 7 are open. Air from the inside of the room flows into open valve 1 into the inlet 16 of the compression/expansion unit 21 and out through compression air outlet 40. With valve 3 open, the compressed air flows through ground coil 19 and returns through valve 7 to the compression/expansion unit 21 and out expander outlet 22 where it is cooled. In a cooled state, the air flows through open valve 13 back into the room from where it came. When used to cool a building, the air is normally heated to 220° F. or higher, which sterilizes the air.

The system of FIG. 13 just described is useful when using the system for heating when there is no fuel such as gas available. Attention is now directed to FIG. 14 which is useful for heating when there is cheap fuel, for example gas, available. Shown in FIG. 14 is the compression/expansion unit 21. Shown thereon is the compression/expansion unit 21 having inlet 16 and compressed air outlet 40. Outlet 40 is connected to conduit 220 which divides into conduit 222 and 224 which has valves 35 and 29 respectively therein. The conduit 224 extends through gas heater 31. The compressed air inlet or secondary air inlet 38 has a conduit 206 which connects to two Y branches 208 and 210. Branch 208 has valve 27 therein, and branch 210 has valve 33 therein. A conduit connected to the outlet of valve 35 is connected to ground coil 19. This connects to another conduit to valve 33 whose outlet is connected to inlet 38.

When it is desired to use the unit in FIG. 14 as a heating unit, valve 35 and 33 are closed, and valve 29 and 27 are open. Thus, room air comes into inlet 16, is compressed, and exits compression outlet 40, flows through valve 29 to the gas heater 31 where an additional amount of heat is added. The air then flows through open valve 27 to inlet 38 where it is expanded and then returns to the room from where the air was first obtained. In the operation just described, the device functions as an open "Brayton" cycle. If the home being heated has an inexpensive natural gas supply, for example, one can heat the air after it has been compressed. This added heat heats the room, driving the unit driver motor at the same time, and also results in synchronous energy production, e.g. cogeneration. Air is returned through the unit to recover much of the horsepower used in compression. Because of the added heat from the combusted fuel, the motor should work as a synchronous generator. This will provide a higher energy efficiency than existing furnace units and results in a cogeneration opportunity.

When it is desired to operate the unit in FIG. 14 as an air cooler for a home, valve 27 and 29 are closed, and valves 33 and 35 are opened, then it can operate similarly to that described above in regard to FIGS. 2 and 3. The air to be cooled from the room enters through inlets 16 to the compression expansion unit 21, out outlet 40 through conduit 222 and opened valve 35, and through ground coil 19, cooling the warm compressed air and then returns through open valve 33, conduit 210 and 206 to compressed air inlet 38. It then flows through the unit 21 where it is expanded, cooling the air, and through outlet 22 into the room from which the air is to be cooled.

Figure 20:
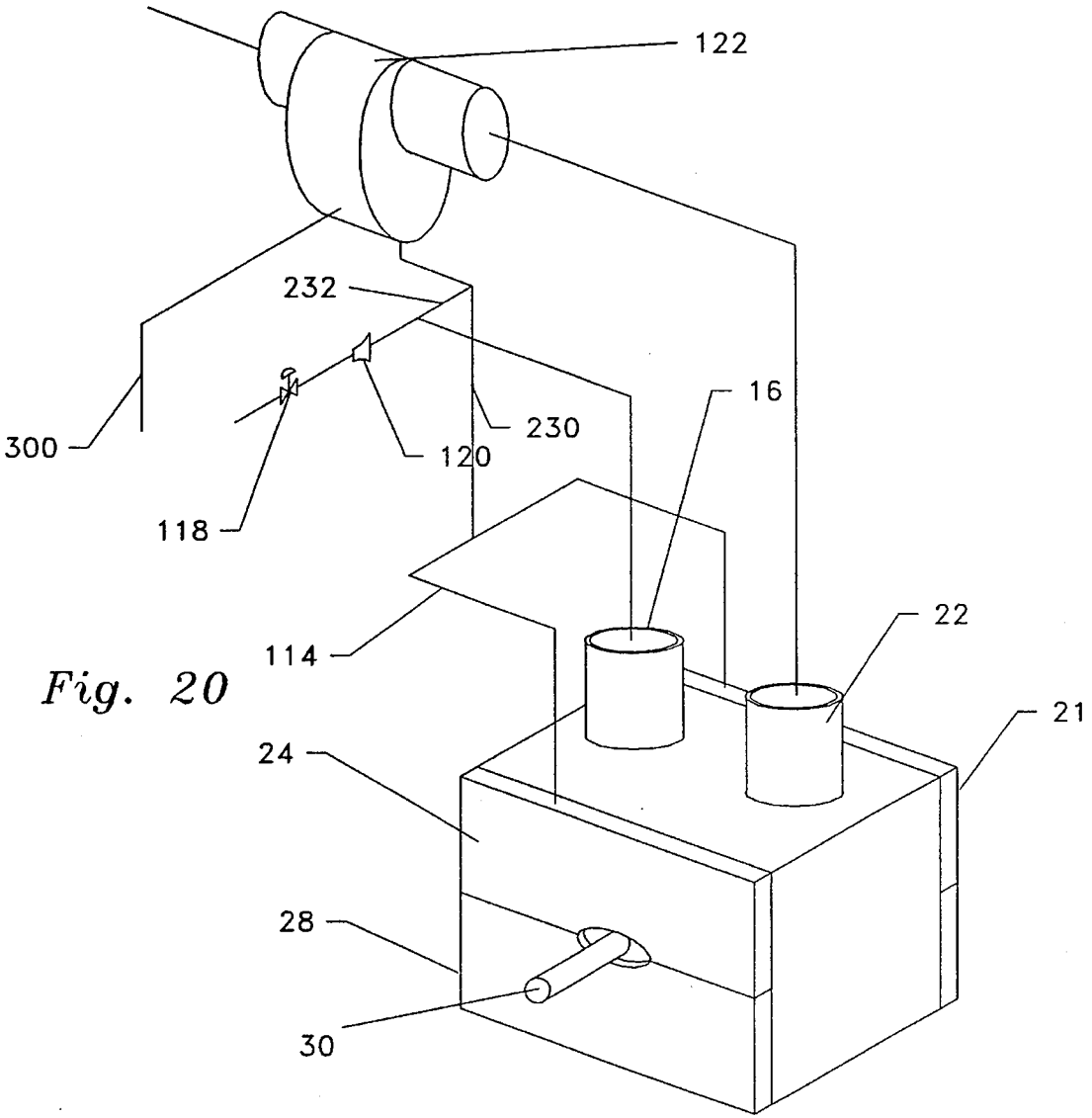
FIG. 20 illustrates schematically a water recirculation-air distribution system.

Attention is next directed to FIG. 20. Sometimes it is desired to extract or remove some of the water from the air which is being processed or circulated through the unit. Other times it is desired to add outside water to the system. The device in FIG. 20 permits either or both. Shown thereon is the compressor/expander unit 21 having primary air inlet 16 and expanded air outlet 22. There is also a top half cover 24 and a bottom half cover 28 with shaft 30 extending therethrough. The outlet air from outlet 22 goes through a conduit to a condensate or circulation trap 122 which will be more fully described in relation to FIGS. 21, 21B, 21C, and 21D. The water trapped in the lower portion of trap 122 flows through conduit 114, splits into conduits 230 and 232. Conduit 232 flows downwardly into the seal 60, similarly, as shown in FIG. 12. Conduit 230 provides water to the air flowing into the inlet 16. If desired, an outside water source can be admitted through valve 118 and to conduit 232 to add additional water if it is needed. If desired, a spray nozzle 120 can be used. Valve means and conduit means can also be provided to remove the water from the system if the humidity is such that that is desirable.

Figure 21A:
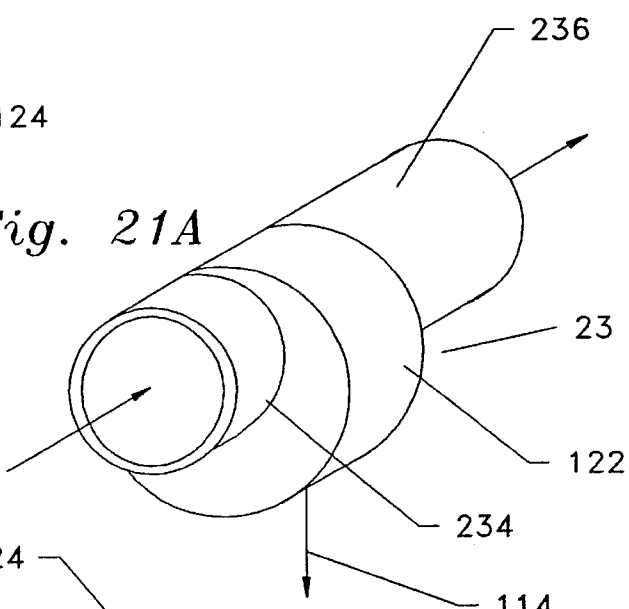
FIG. 21A is an isometric view of the condensate recirculation trap of FIG. 26.
Figure 21B:
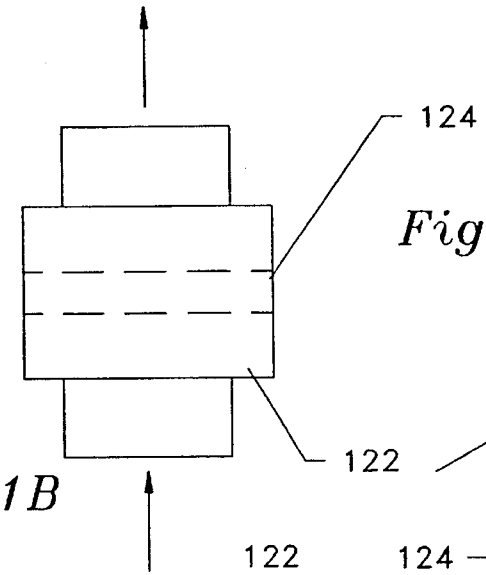
FIG. 21B is a top view of FIG. 21A.
Figure 21C:
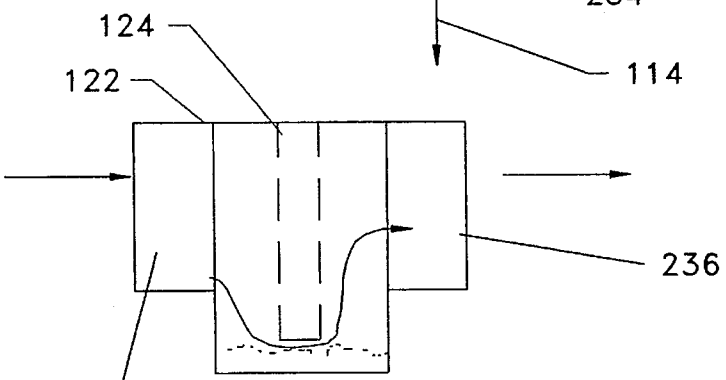
FIG. 21C is a side view of FIG. 21A.
Figure 21D:
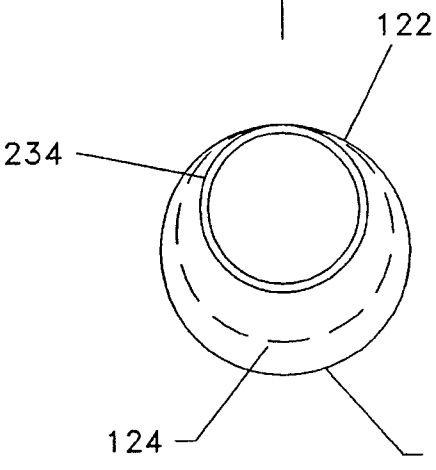
FIG. 21D is an end view of FIG. 21A.

Attention is directed back to FIGS. 21A through 21D to show more details of the condensate or circulation trap 122. FIG. 21A shows the trap in isometric view having air inlet 234 and air outlet 236 through which the expanded air from outlet 22 of the compressor/expander unit 21 flows. There is an enlarged portion 238 which has an outlet 240 through which the condensed water can flow into line or conduit 114. FIG. 21B shows a top view in which the enlarged portion 238 is shown to have a condensate baffle 124. As shown more clearly in FIG. 21C, when air flows in, it flows in inlet 234, down around the bottom end of condensate baffle 124 where the water is knocked out with water collection in the bottom thereof, and air flows back up on the downstream side of the baffle 124 and out outlet 236.

The improved rotary vane compression/expansion device described hereinbefore can be used in a system for using wind energy to provide fresh water from sea water for isolated coastal regions and islands. In this system, salt water is placed in an insulated storage tank and hot compressed air from the compressor unit flows through heating coils in the stored water and causes it to evaporate or form steam. The expanded air from the expander side of the unit goes through a cooling panel or coils in the top of the dome covering the tank and causes the steam to condense. A catch trough is provided below these cooling coils to catch the condensate and the fresh water is then drained from the catch trough and used as needed.

Figure 15:
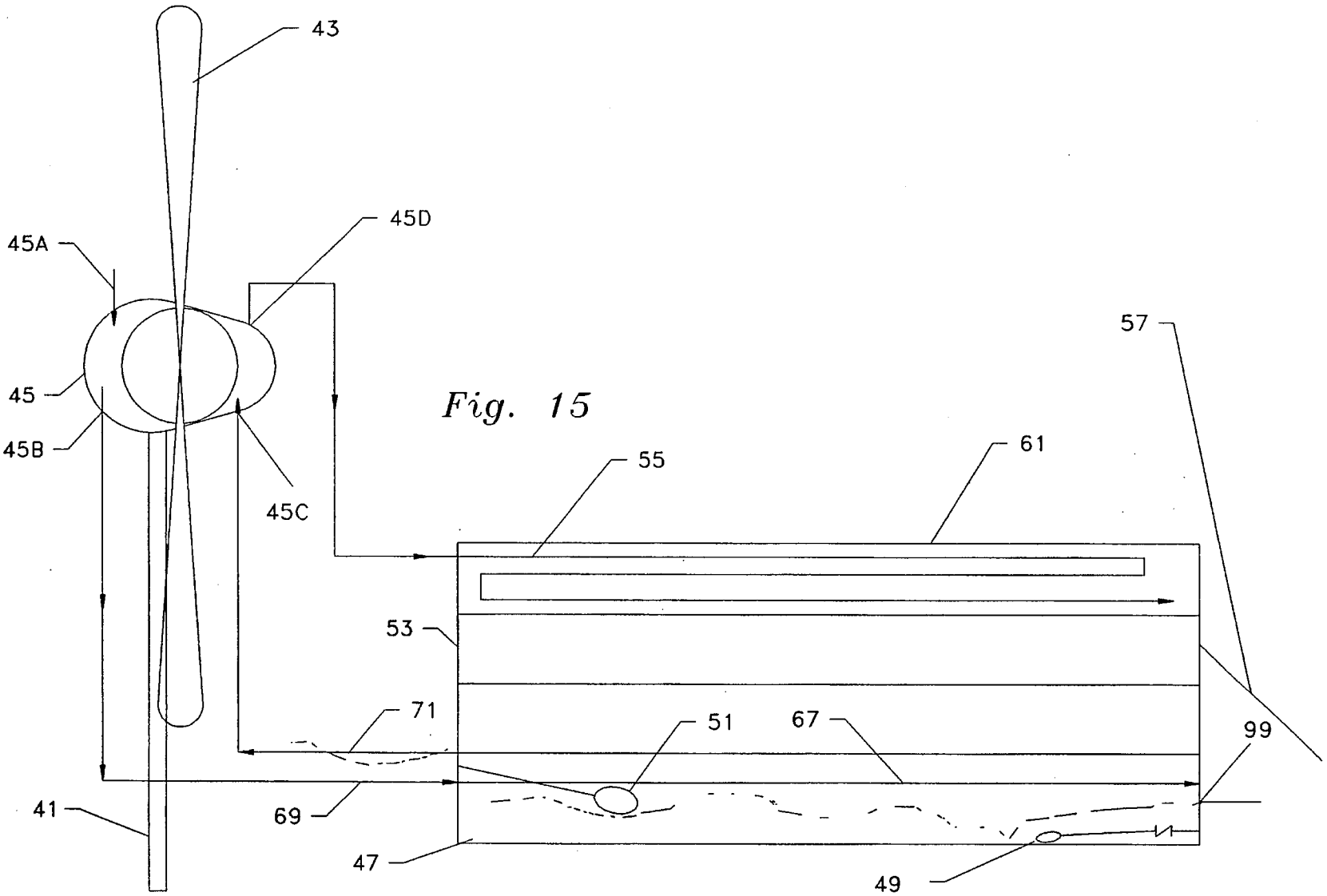
FIG. 15 is a schematic view of a wind driven electrical power desalinization/effluent/water separator using the rotor and housing unit of FIG. 1.

Attention is now directed to FIG. 15 which shows a compressing/expansion unit 45 which is similar to unit 21 supported above the ground by support pole 41. A wind turbine 43 is used to drive the rotor within unit 45. Insulated salt water storage tank 47 is provided and has an inlet valve 51 to fill the bottom portion of the tank 47. As shown, this storage tank 47 is supported in a body of salt water which has a surface 99. The fill valve 51 maintains the level at an appropriate height. The bottom part of the tank 47 is provided with heating coils 67 which is connected to conduit 69 which conveys compressed hot air from unit 45. Heat from this hot air is transferred to the stored salt water. After the air passes through the heating coils, it is conveyed through conduit 71 to secondary inlet valve 45C of the unit 45. There it is expanded in the unit and exits at 45D as cooled air due to expansion. This outlet is connected to a conduit connected to cooling panel 55 which is in the top portion of the dome cover 61 which covers the storage tank 47. As the cool air passes through the cooling panel, it cools and condenses the water vapor or steam. The air then exits into the atmosphere. Beneath the cooling panel 55 is a condensate catch trough 53. A fresh water drain line 57 is provided from trough 53, and the water in drainage line 57 can be caught and used as needed. After a significant amount of water has been evaporated, the water in the bottom of storage tank 47 becomes highly concentrated with salt and is much denser than the water in the body of water that it is supported. Therefore, the dump flush valve 49 can be used to let the high density water flow out of the storage tank 47 back into the body of water from whence it came. If needed, a pump may be used to pump the water from the high density area of the tank.

Figure 17:
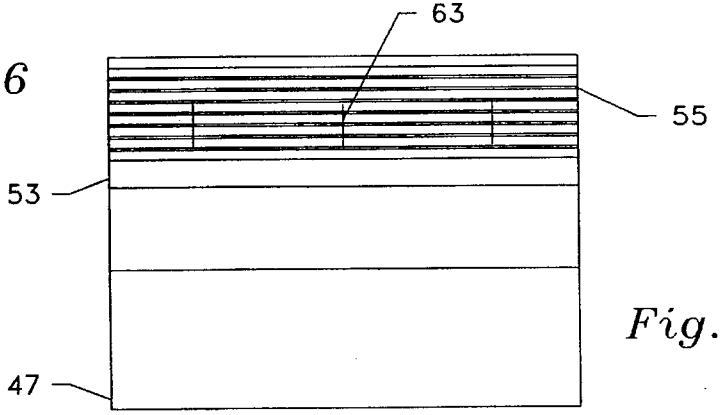
FIG. 17 shows cooling coils in the dome.
Figure 16:
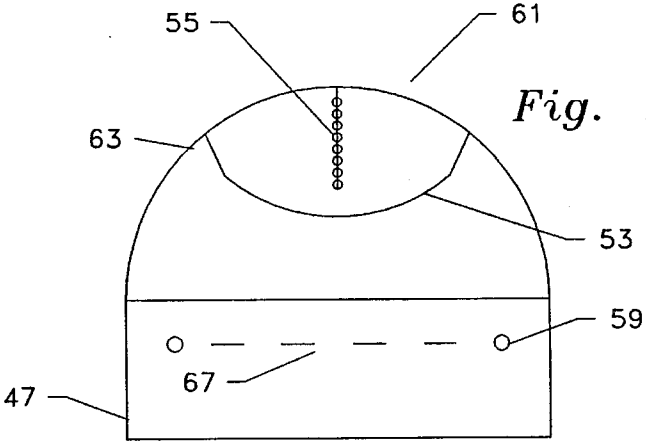
FIG. 16 is an end view of the desalinization water holding unit of FIG. 15 and showing the catch trough for condensate.

FIGS. 16 and 17 show one way of supporting the cooling panel 55 in dome 61. The cooling panel 55 is supported from the top of the dome. The condensate catch trough 53 is supported by support member 63 which can be chains, or steel, or whatever, if necessary. As shown, these supports are widely separated so that steam or evaporated water can flow between the sides of the catch trough 53 and the top of the dome and permits the water vapor or steam to flow freely about cooling panel 55.

Figure 19:
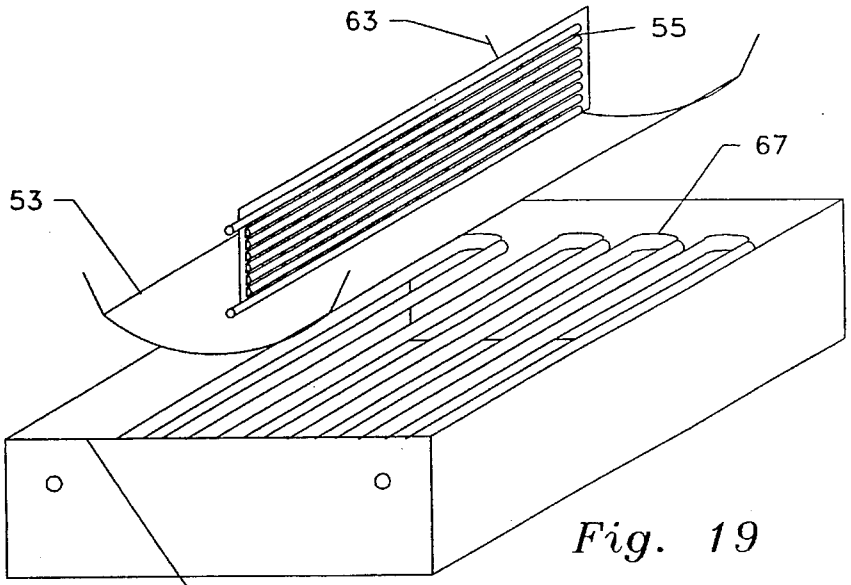
FIG. 19 is an isometric view of the cooling panel, condensate catch trough, and heating coils.
Figure 18:
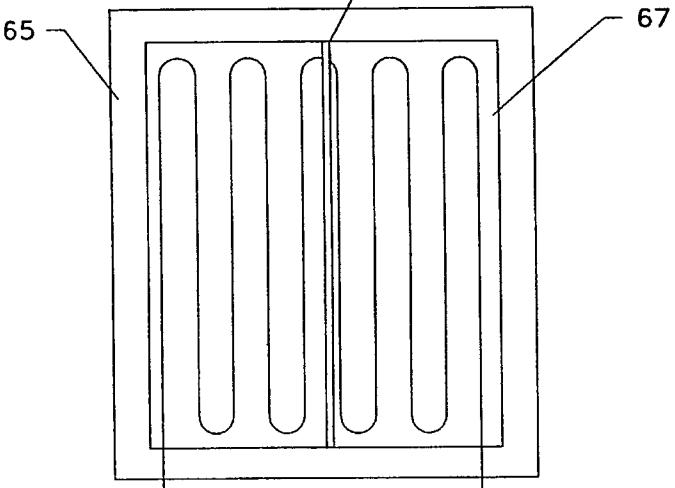
FIG. 18 illustrates the arrangement of the heating coils in the salt water.

Attention is now directed to FIG. 18 which shows the top view illustrating the positioning of the hot vapor lines 67 across the bottom of the tank 47. FIG. 19 is an isometric view showing a preferred positioning of the insulated support for the tank, the hot evaporation line 67, cooling panel 53, catch trough support 63.

Many modifications can be made to the system shown in FIGS. 15–19. For example, if there is plenty of electricity available and a small amount of wind, the unit 45 can be driven by an electric motor. Further, if desired, the insulated storage tank 47 and its accompanying components, such as the dome 61 may be placed on ground, and the salt water could be pumped into the tank 47 and the resulting high density salt water disposed of in an environmentally acceptable manner.

As shown, various modifications can be made. For example, it is possible to construct this unit in sections to increase its capacity by adding a section. To do this, one would remove one end, e.g. 24 and 28, add a matching housing section to the open end of the unit, replace the rotor with one of proper length, and secure the end section 24 and 28 to the outer end of the added housing section.

DESIGN EXAMPLE

The concepts described herein can be designed and built by one skilled in the art using engineering design and construction principles and methods. However, it may be helpful to provide a Design Example of a compressor/expansion unit such as one used to cool a home. This description of the Design Example is not to limit the invention but is submitted merely as an aid to rapid understanding.

The purpose of this example is to provide information on design steps involved in sizing and constructing a single fluid, compression/expansion, telescoping vane, ovoid geometry unit.

Step 1 Change of Enthalpy Requirements

A two-ton cooling unit has been selected as an appropriate size for demonstration. As a rule of thumb, homes in the southwest region require approximately one ton of cooling for a 500 ft^2 living space with insulations of R-17 in the walls and roof. A two-ton unit would therefore satisfy approximately 1000 ft^2. A minimum air turnover rate of once per hour would satisfy ASHRAE standard 62-1989. Therefore:

The flow rate of air through the unit would be equal to (1000 ft^2)(8 ft ceilings)(1 hour)(60 minutes/1 hour) =133 ft^3/minute To move 24000 BTU/hour the enthalpy of the air would be reduced by (24000 BTU/hour)(1 hour/60 minutes)(1 minute/133 ft^3)=3 BTU/ft^3

On the worst possible day the temperature in the room air could be as high as 110° F. When cooled, the temperature would be 70° F. The average temperature would be 90° F. This would result in a density of the air of rho=(M)(P)/(10.73)(T)(Z)

where rho=density of air

M=the mole number of air

P=atmospheric pressure

T=temperature

Z=the compressibility rho=(29)(14.7)/(10.73)(540° R.)(1)=0.0736 lbm/ft^3 and

R=° Rankin

The enthalpy change required of the air is (3 BTU/ft^3)(1 ft^3/0.0735 lbm)=40.775 BTU/lbm Step 2 Air Displacement Requirements The variables used in this discussion are illustrated in FIGS. 6, 7, 8, 23, and 24.

AF air flow required by the design=133 ft^3/min.

Vdisp=the amount of air displaced when the unit goes through one complete revolution RPM=the number of revolutions per minute the unit is turning. For the purpose of this example the unit will be turning at 900 RPM.

Vspace=the number of vane spaces in the unit design. For this design the unit will be sized at 8 spaces.

*AF*=(Vdisp)(Vspace)(RPM) 133 ft^3/min=Vdisp (8)(900) Vdisp=0.01847 ft^3=31.92 in^3

Vdisp=the largest volume between the vanes—the smallest volume between the vanes from the beginning of compression to end.

Vdisp=$V_1$–$V_2$. $V_1$ is item 404. $V_2$ is item 402 (FIG. 24) The volume between the vanes is the cross-sectional area between the vanes times the length of the unit.

$V_1$=$A_1$*W $V_2$=$A_2$*W

The cross-sectional area between the vanes is $A_1$=((alpha)(pi)(W)/(360))($R_1$^2=r^2)

Where

Alpha=the angle between the vanes in cross section pi=3.14159

W=the length of the unit $R_1$=the radius of the large arc $R_2$=the radius of an arc at minimum displacement r=the radius of the rotor Therefore Vdisp W

=$A_1$(W)–($A_2$)(W)

=((Alpha)(pi)(W)/(360))[($R_1$^2–r^2)–($R_2$^2–r^2)]

Vdisp(360)/(W)(Alpha)(pi)=$R_1$^2–$R_2$^2

From the definition of the geometry the ratio of $R_1$/$R_2$=1.472

Vdisp (360)/(W)(Alpha)(pi)=2.167($R_2$)^2–$R_2$^2=1.167($R_2$^2) (((VdisP)(2.182)/W)^0.5)=$R_2$ This must be solved iteratively to ensure that W=2*$R_1$ So $R_2$=2.639"

W=10"

$R_1$=3,885

$R_1$=½ of $L_1$ shown hereinbefore.

Therefore this defines $D_1$, $D_2$ and the other variables from this ratio. This allows for the construction of the ovoid geometry.

So the outside dimensions of the unit under these criteria are 10"×10"×10".

Step 3 Heat Exchanger Sizing

The intention is to place high temperature plastic pipe 4' underground for heat exchange. The goal is to reach a depth where the mean temperature of the earth is 60° F.

Definitions:

Pin1=pressure into the compressor side=14.7 psia

Pout1=pressure out of the compressor side=34.7 psia

Tin1=temperature into the compressor side=110° F.

Tout1=temperature out of the compressor side=267° F.

Pin2=pressure into the expander side=34 psia

Pout2=pressure out of the expander=14.7 psia

Tin2=temperature out of the expander/back to the room=70° F.

The earth is assumed to maintain a temperature of 60° F.

The pipe used for heat exchange is 2" in diameter.

The analysis is based on equations from Holman's Heat Transfer.

The density of the air is rho=(29)(34.7)/(10.73)(726)(1)=0.129 lbm/ft^3

Re=(rho*Ve*d)/(nu)

Where

Re=Reynolds Number rho density=0.129 lbm/ft^3 d=the inside diameter of the pipe=0.17 ft.

nu=dynamic viscosity of the air =1.395*10^−5 lbm/ft*s

Ve=the velocity of the air in the pipe=101.6 ft/s

Re=159,719

Nu=Nusselt's number

Pr=Prandtl's number

Nu 0.023(Re^8)(Pr^n) where n=0.3 or 0.4 n=0.3 if the fluid is being heated n=0.4 if the fluid is being cooled

Pr=0.7

Therefore

Nu=300.56 h=the heat transfer coefficient in BTU/hr*ft^2*deg. F.=k(Nu)/Do k=kplastic from Mark's handbook approximately 0.019

Do=outside diameter assume 0.17' h=33.59 BTU/hr ft^2 deg. F.

The heat transfer rejected per foot is

Q/L=h(area for 1 foot of length)(delta T)

Q/L=(33.59)(0.524)(267-60)=1.01 BTU/ft*S

The change in enthalpy required of the air was

3 BTU/ft^3

The flow rate of the air was 133 ft^3/min. which equals 2.22 ft^3/S (3 BTU/ft^3)(2.22 ft^3/S)=6.66 BTU/S (6.66 BTU/S)(ft*S/1.01 BTU)=6.7 ft of 2" tube required In the southwest region of the United States a safety factor of 2 is used on ground source heat exchangers to overcome heat sink saturation. Because the delta T is so high and because the heat exchange system is so inexpensive, it would be recommended that a safety factor of 4 be used. Therefore, the length of pipe required for the cooling system would be 25'.

Step 4 Horsepower Used Calculation

The horsepower used is the net difference in enthalpy in the system.

Horsepower used=$H_2-H_1-H_3-H_4$ $H_1$ is enthalpy on intake $H_2$ is enthalpy before the exchanger $H_3$ is enthalpy after the exchanger $H_4$ is enthalpy at exhaust Horsepower used=(173−136)/0.85 −(158−126)0.85=5 BTU/lbm A 0.85 mechanical efficiency has been used as common to rotary vane compression devices.

(16.75 BTU/lbm)(133 ft^3/min)(0.0736 lbm/ft^3)(60 min/hour) =9839 BTU/hr 9839(1 Horsepower/2545 BTU/hr)=3.866 Horsepower The Coefficient of Performance (COP) of the system is 24000 BTU/9839 BTU=2.439

This is comparable to existing 2 ton systems.

While the invention has been described with a certain degree of particularity, it is manifest that many changes may be made in the details of construction without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A rotary vane compression/expansion device comprising:

a rotor having a shaft with an axis;

a housing having an inner wall, an air inlet, and an air outlet, the shape of the cross-section of the inner wall of said housing in a plane perpendicular to said axis is an ovoid shape;

a plurality of vanes extending radially outwardly from said axis to rotationally contact the inner wall;

means to move said housing with respect to said rotor.

2. A device as defined in claim 1 in which said shape includes an arc of a first circle having a diameter $D_2$ having a first end point and a second end point and a spaced apart second arc of a circle having a diameter $D_1$ and having a third end point and a fourth end point and a straight line connecting said first and third end points and a second straight line connecting said second and fourth end points.

3. A device as defined in claim 2 in which said first arc is within the range of about 194° to about 234°, said second arc is in the range of about 122° to about 164°.

4. A device as defined in claim 3 in which the ratio of each straight line to the diameter of the second arc is approximately 0.84.

5. A device as defined in claim 3 in which the ratio of the linear dimension of the first arc to the second arc is about 1.47.

6. A device as defined in claim 3 in which said first arc extends about 214° from said first to said second points and said second arc extends about 142° from said third point to said fourth point.

7. A device as defined in claim 1 for changing the temperature of air in a space and in which said means to move said housing includes a first cylinder on one side of said housing and a second cylinder on the other side of said housing, each cylinder having a movable piston therein whose directional movement is perpendicular to the axis of said rotor, fluid pressure taken from said compressed air outlet connected through a first conduit to said first piston and through a second fluid conduit to said second piston, each said conduit having installed therein a pressure regulator and a solenoid valve, each said control valve to be opened or closed in response to the temperature in the space for which said device is to control.

8. A device as defined in claim 1 in which said housing has an upper and a lower side member on each side thereof through which said shaft extends, each said side having a movable seal therein, including a seal slide track in each said upper and lower side member, a movable positionable seal through which said shaft extends, said movable positionable seal movable along said track as force is applied along said track as force is applied to said housing by said moving means.

9. A device as defined in claim 8 in which said movable positionable seal includes a disc supported by and rotatable with said shaft, said slide track includes a notch in said upper and lower side members, said disc movable and rotatable within said notches.

10. A device as defined in claim 1 in which the vanes are telescoping, including a rotor with a slot therein for each vane, an inner vane within each said rotor slot, said inner vane having a slot therein, and a second vane nestled inside said second slot, first means to force said first vane outwardly and second means to force said second vane outwardly from said first vane.

11. A device as defined in claim 10 including a cylindrical roller bearing on the end of each of the outer vanes.

12. A device as defined in claim 1 including a roller bearing on the outer edge of each said vane for rolling along the surface of said inner wall.

13. A device as defined in claim 1 in which said moving means includes a cylinder, a piston within said cylinder for moving the housing in a direction perpendicular to the axis of said rotor and in which power for moving said piston is obtained from air pressure produced in said housing.

14. A device as defined in claim 13 in which the cross-section configuration of the inner wall of said housing in a plane perpendicular to the axis of said rotor is ovoid.

15. A device as defined in claim 14 in which the movement of said housing is a function of temperature.

16. A device as defined in claim 1 in which said housing has a secondary outlet, a secondary inlet, a heat exchanger, and a conduit connected to said secondary air outlet extending through said heat exchanger and connected to the secondary air inlet.

17. A unitary rotary vane/expansion device comprising:

a rotor having an axis;

a housing for said rotor and having an inner wall, an air inlet, a compressed air outlet, a return air inlet, and an expanded air outlet;

the configuration of the cross-section of the inner wall of said housing in a plane perpendicular to said axis has a shape which includes a first arc having a first end point and a second end point, and a spaced apart second arc having third and fourth end points, said arcs of circles opening toward each other; and a first straight line connecting said first and third end points, and a second straight line connecting said second and fourth end points to form an enclosed configuration.

18. A device as defined in claim 17 including a heat exchanger and a conduit in operating vicinity of said heat exchanger and connecting said compressed air outlet to said return air inlet.

19. A device as defined in claim 17 in which said first arc is within the range of about 194° to about 234°, said second arc is in the range of about 122° to about 164°.

20. A device as defined in claim 17 in which said first arc is a part of a first circle having a diameter $D_1$ and the second arc is a part of a circle $D_2$ in which $D_2$ is less than $D_1$ and in which said air inlet is in the first portion of the housing at the cross-section having said first arc, said compressed air outlet is in said first portion of the housing, said return air inlet is adjacent said second straight line and a first part of said second arc, and said expanded air outlet is adjacent a second portion of said second arc and said first straight line.

21. A rotary vane compression/expansion device comprising:

a housing having an inner wall, an air inlet, a compressed air outlet, a return air inlet, and an expanded air outlet;

a rotor having an axis;

a plurality of vanes extending radially outwardly from said axis, each said vane having an outer edge;

a cylindrical roller extending along each said outer edge such that as said vane is extended radially outward such that said rollers sealingly contact the inner wall of said housing.

22. A device as defined in claim 21 in which the configuration of said housing in a cross-section in a plane perpendicular to said axis has an ovoidal geometry.

23. A rotary vane compression/expansion device comprising:

a housing having an inner wall, a compressed air outlet, an air inlet, a compressed air inlet, and an expanded air outlet;

a rotor having an axis and a plurality of slots therein;

a plurality of vane means, each said vane means mounted within a slot in said rotor, a first vane mounted in each said slot, each said first vane having an outer edge and biased radially outwardly, each said first vane having a slot along the outer edge thereof;

an outer vane positioned in each said first vane slot and means to extend said outer vane radially outwardly to contact said wall of said housing.

24. A device as defined in claim 23 including roller bearings on the end of each said second vane for rolling along the surface of said inner wall as said rotor rotates.

25. A device as defined in claim 24 in which the cross-section of said housing perpendicular said axis defines a configuration which is ovoidal in shape.

26. A rotary vane compression/expansion device comprising:

a housing having an inner wall, an air inlet, a compressed air outlet, a secondary air inlet, and an expanded air outlet;

a rotor having an axis;

means to rotate said rotor;

a plurality of vanes extending radially outwardly from said rotor to rotationally contact the inner wall;

structural means capable of moving said housing with respect to said rotor while said rotor is rotating.

27. A device as defined in claim 26 in which the configuration of said inner wall of said housing in a plane perpendicular to said rotor has an ovoidal shape.

28. A method of operating a rotary vane compression/expansion unitary device having a housing with an inner wall, a rotor having a shaft with an axis, and a plurality of vanes extending radially outwardly from said axis to rotationally contact the inner wall, the method which comprises:

positioning said rotor at a first position within said housing;

rotating said rotor until the rotor approaches its operational revolutions per minute;

then during rotation moving said housing with respect to said rotor to a second position to obtain a selected compression of air.

29. A method as defined in claim 28 in which said air is compressed and said rotor is positioned with respect to said housing to obtain minimum compression when the rotor is first rotated and thereafter moving said housing with respect to said rotor to obtain greater compression.

30. A method of operating a rotary vane compression/expansion device which has a housing having an inner wall, an air inlet, and compressed air outlet, a secondary inlet, and a standard air outlet, and a rotor having a shaft with an the axis, and having a plurality of vanes extending radially outwardly from said axis;

measuring the temperature of the air at a selected point to obtain a control signal;

rotating said rotor;

moving said housing with respect to said rotor in response to said control signal.

31. A rotary vane compression/expansion device comprising:

a rotor having an axis;

a housing for said rotor in which said rotor rotates, the configuration of the cross-section of the inner wall of said housing in a plane perpendicular to said axis has a shape which includes a first arc having a first end point and second end point and a second spaced apart second arc having third and fourth end points, said arcs of circles opening toward each other and of different diameters, and a first straight line connecting said first and third end points and a second straight line connecting said second and fourth end points;

means to rotate said rotor.

32. A device as defined in claim 31 including means to move said rotor with respect to said housing while said rotor is rotating.

33. A rotary vane compression/expansion device comprising:

a housing having an inner wall, an air inlet, and an air outlet;

a rotor having a shaft with an axis;

a plurality of vanes extending radially outwardly from said axis to rotatably contact the inner wall;

means to move said housing with respect to said rotor;

a cross-section of the inner wall of said housing in a plane perpendicular to said axis a shape including an arc of a first circle having a diameter $D_2$ having a first end point and a second end point and a spaced apart second arc of a circle having a diameter $D_1$ and a third end point and a fourth end point and a straight line connecting said first and third end points and a second straight line connecting said second and fourth end points, said first arc is within the range of about 194° to about 234°, and said second arc is in the range of about 122° to about 164°.

34. A device as defined in claim 33 in which the ratio of each straight line to the diameter of the second arc is approximately 0.84.

35. A device as defined in claim 33 in which the ratio of the linear dimension of the first arc and second arc is about 1.47.

36. A rotary vane compression/expansion device for changing the temperature of air in a space comprising a housing having an inner wall, an air inlet, and an air outlet;

a rotor having a shaft with an axis;

a plurality of vanes extending radially outwardly from said axis to rotationally contact the inner wall;

means to move said housing with respect to said rotor;

said means to move said housing includes a first cylinder on one side of said housing and a second cylinder on the other side of said housing, each cylinder having a moveable piston therein whose directional movement is perpendicular to the axis of said rotor, a first conduit, a second conduit, fluid pressure taken from said compressed air outlet connected to said first conduit and to said second fluid conduit to said second piston, each said conduit having installed therein a pressure regulator and a solenoid valve, each said control valve to be opened or closed in response to temperature in the space for which said device is to control.

37. A rotary vane compression/expansion device comprising:

a housing having an inner wall and an air inlet and an air outlet;

a rotor having a shaft with an axis;

a plurality of vanes extending radially outwardly from said axis to rotationally contact the inner wall;

means to move said housing with respect to said rotor;

said housing has an upper and lower side member on each side thereof through which said shaft extends, each said side having a moveable seal therein, including a seal slide track in each said upper and lower side member, a moveable positionable seal through which said shaft extends, said moveable positionable seal moveable along said track as force is applied to said housing by said moving means.

38. A rotary vane compression/expansion device comprising:

a housing having an inner wall, an air inlet, and an air outlet;

a rotor having a shaft with an axis;

a plurality of vanes extending radially outwardly from said axis to rotationally contact the inner wall;

means to move said housing with respect to said rotor;

said moving means includes a cylinder, a piston within said cylinder for moving the housing in a direction perpendicular the axis of said rotor and in which said power for moving said piston is obtained from air pressure produced in said housing.

39. A rotary vane compression/expansion device comprising:

a rotor having an axis;

a housing having an inner wall, an air inlet, and an air outlet;

a plurality of vanes extending radially outwardly from said axis to rotationally contact the inner wall;

means to move said housing with respect to said rotor;

said housing having a secondary outlet, a secondary inlet, a heat exchanger, and a conduit connected to said secondary air outlet extending through said heat exchanger and connected to the secondary air inlet.

* * * * *